US010982835B2

(12) United States Patent
Shima et al.

(10) Patent No.: US 10,982,835 B2
(45) Date of Patent: Apr. 20, 2021

(54) LIGHT-EMITTING DEVICE, LIGHTING DEVICE, AND OPTICAL MEMBER

(71) Applicant: NICHIA CORPORATION, Anan (JP)

(72) Inventors: Kohei Shima, Tokushima (JP); Yohei Kawano, Tokushima (JP)

(73) Assignee: NICHIA CORPORATION, Anan (JP)

( * ) Notice: Subject to any disclaimer, the term of this patent is extended or adjusted under 35 U.S.C. 154(b) by 0 days.

(21) Appl. No.: 16/851,820

(22) Filed: Apr. 17, 2020

(65) Prior Publication Data

US 2020/0332981 A1 Oct. 22, 2020

(30) Foreign Application Priority Data

Apr. 18, 2019 (JP) ..... JP2019-079413

(51) Int. Cl.

| | |
|---|---|
| ***F21V 5/04*** | (2006.01) |
| ***F21V 5/00*** | (2018.01) |
| ***F21V 7/00*** | (2006.01) |
| ***F21V 7/05*** | (2006.01) |
| ***F21V 13/04*** | (2006.01) |

(52) U.S. Cl.

CPC ..... *F21V 5/046* (2013.01); *F21V 5/007* (2013.01); *F21V 7/0083* (2013.01); *F21V 7/05* (2013.01); *F21V 13/04* (2013.01)

(58) Field of Classification Search

CPC . F21V 5/04; F21V 5/045; F21V 5/048; F21V 5/007; F21V 7/04; F21V 7/0083; F21V 13/04

See application file for complete search history.

(56) References Cited

U.S. PATENT DOCUMENTS

| | | | | |
|---|---|---|---|---|
| 2005/0265040 | A1 | 12/2005 | Lin | |
| 2009/0251897 | A1 | 10/2009 | Kabuki et al. | |
| 2013/0003409 | A1 | 1/2013 | Vissenberg et al. | |
| 2015/0219303 | A1 | 8/2015 | Kai et al. | |
| 2015/0252981 | A1* | 9/2015 | Nakamura | F21K 9/232 362/308 |
| 2017/0198884 | A1* | 7/2017 | Nakamura | F21V 5/045 |
| 2017/0211750 | A1 | 7/2017 | Yotsumoto et al. | |
| 2017/0307172 | A1* | 10/2017 | Liu | F21V 5/048 |

(Continued)

FOREIGN PATENT DOCUMENTS

| | | | |
|---|---|---|---|
| CN | 104848058 | A | 8/2015 |
| JP | 2007-265726 | A | 10/2007 |
| JP | 2007-335101 | A | 12/2007 |

(Continued)

*Primary Examiner* — Andrew J Coughlin
*Assistant Examiner* — Keith G. Delahoussaye
(74) *Attorney, Agent, or Firm* — Birch, Stewart, Kolasch & Birch, LLP

(57) ABSTRACT

A light-emitting device includes a concentrator, a first tubular body surrounding the concentrator, one or more first light-emitting elements disposed at a position corresponding to the concentrator, and a plurality of second light-emitting elements. The first tubular body is transparent. The first tubular body has a plurality of recesses formed in an end portion of the first tubular body. Portions of the first tubular body between the recesses form light guide portions. The plurality of second light-emitting elements are disposed at positions corresponding to a plurality of the light guide portions.

18 Claims, 28 Drawing Sheets

(56) References Cited

U.S. PATENT DOCUMENTS

| | | | | |
|---|---|---|---|---|
| 2018/0245771 | A1* | 8/2018 | Liu | F21V 5/007 |
| 2019/0113677 | A1 | 4/2019 | Kawano | |

FOREIGN PATENT DOCUMENTS

| | | | |
|---|---|---|---|
| JP | 2009-253067 | A | 10/2009 |
| JP | 2012-151120 | A | 6/2012 |
| JP | 2013-522840 | A | 6/2013 |
| JP | 2014-130829 | A | 7/2014 |
| JP | 2015-002018 | A | 1/2015 |
| JP | 2015-111519 | A | 6/2015 |
| JP | 2017-068903 | A | 4/2017 |
| JP | 2018-081134 | A | 5/2018 |
| JP | 2018-190623 | A | 11/2018 |
| JP | 2018-195779 | A | 12/2018 |
| JP | 2019-075297 | A | 5/2019 |
| WO | WO 2016/05253 | A1 | 3/2016 |

* cited by examiner

LIGHT-EMITTING DEVICE, LIGHTING DEVICE, AND OPTICAL MEMBER

CROSS-REFERENCE TO RELATED APPLICATIONS

This application is based upon and claims the benefit of priority from the prior Japanese Patent Application No. 2019-079413, filed on Apr. 18, 2019; the entire contents of which are incorporated herein by reference.

FIELD

Embodiments relate to a light-emitting device, a lighting device and an optical member.

BACKGROUND

In recent years, a lighting device that can switch the light distribution angle is desirable. For example, it is desirable for one lighting device to illuminate an entire room by increasing the light distribution angle for one condition, and to illuminate a narrow area by reducing the light distribution angle for another condition.

SUMMARY

According to one aspect of the present invention, a light-emitting device includes a concentrator, a first tubular body surrounding the concentrator, one or more first light-emitting elements disposed at a position corresponding to the concentrator, and a plurality of second light-emitting elements. The first tubular body is transparent. The first tubular body has a plurality of recesses formed in an end portion of the first tubular body. Portions of the first tubular body between the recesses form light guide portions. The plurality of second light-emitting elements are disposed at positions corresponding to a plurality of the light guide portions.

According to one aspect of the present invention, a lighting device includes the light-emitting device and a cover member covering a side surface of the light-emitting device.

According to one aspect of the present invention, an optical member includes a concentrator, and a first tubular body surrounding the concentrator. The first tubular body is transparent. The first tubular body has a plurality of recesses formed in an end portion of the first tubular body. Portions of the first tubular body between the recesses form light guide portions.

DETAILED DESCRIPTION

First Embodiment

Figure 1:
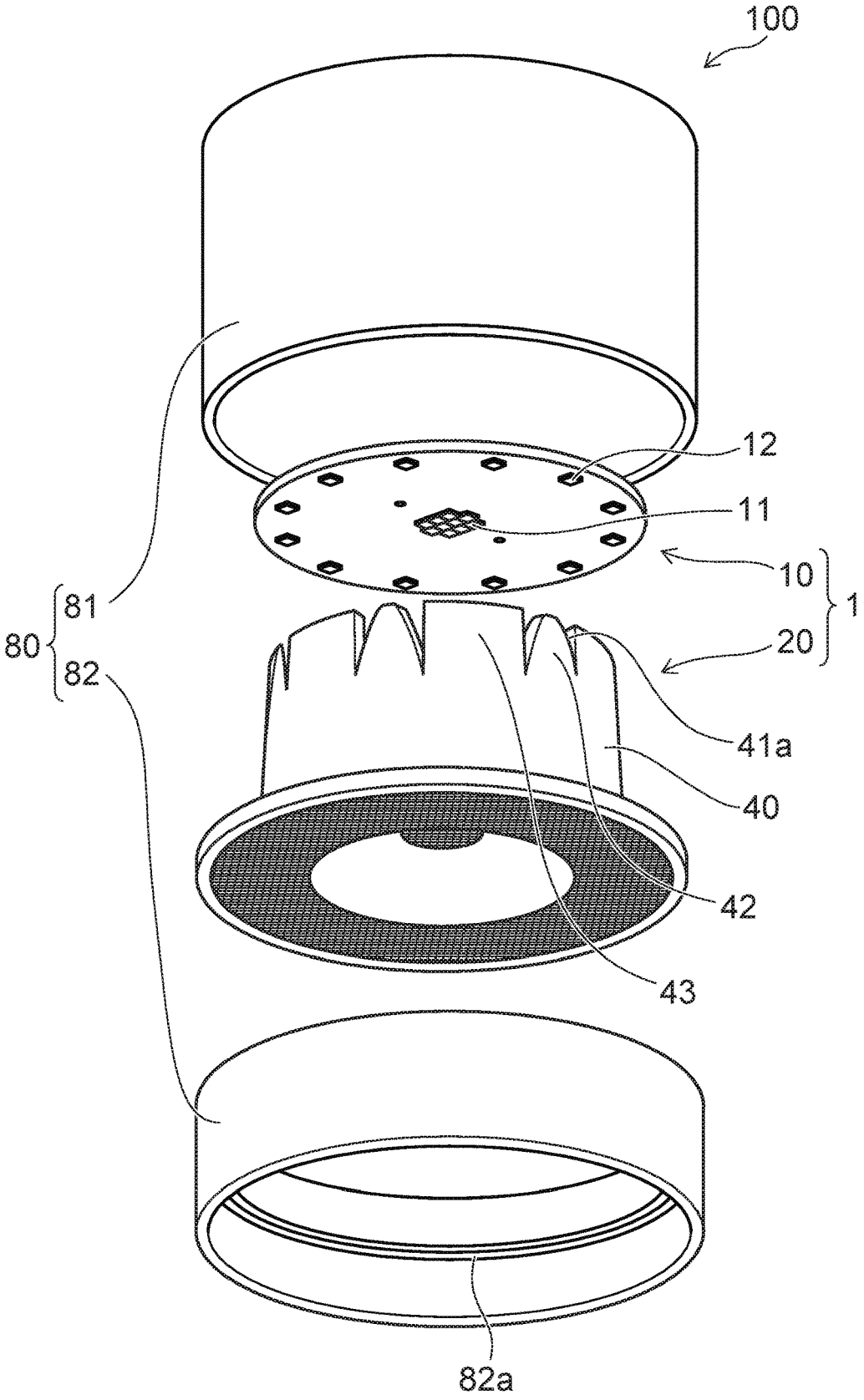
FIG. 1 is an exploded perspective view showing a lighting device according to a first embodiment.

FIG. 1 is an exploded perspective view showing a lighting device 100 according to the embodiment.

First, the configuration of the lighting device 100 according to the embodiment will be summarily described.

The lighting device 100 includes a light-emitting device 1, and a cover member 80 covering the side surface of the light-emitting device 1. The light-emitting device 1 includes a light source part 10 and an optical member 20.

The optical member 20 includes a concentrator 30 and a first tubular body 40; the first tubular body 40 surrounds the concentrator 30 and is transparent; multiple recesses 41*a* are formed in an end portion of the first tubular body 40; and portions of the first tubular body 40 between the recesses 41*a* are light guide portions 42 and 43. The light source part 10 includes one or more first light-emitting elements 11 disposed at a position corresponding to the concentrator 30, and multiple second light-emitting elements 12 disposed at positions corresponding to the multiple light guide portions 42 and 43. In an example, the lighting device 100 is mounted to the ceiling of a room and emits light downward. However, the mounting position of the lighting device 100 and the emission direction of the light are not limited thereto.

Details will now be described.

Figure 2:
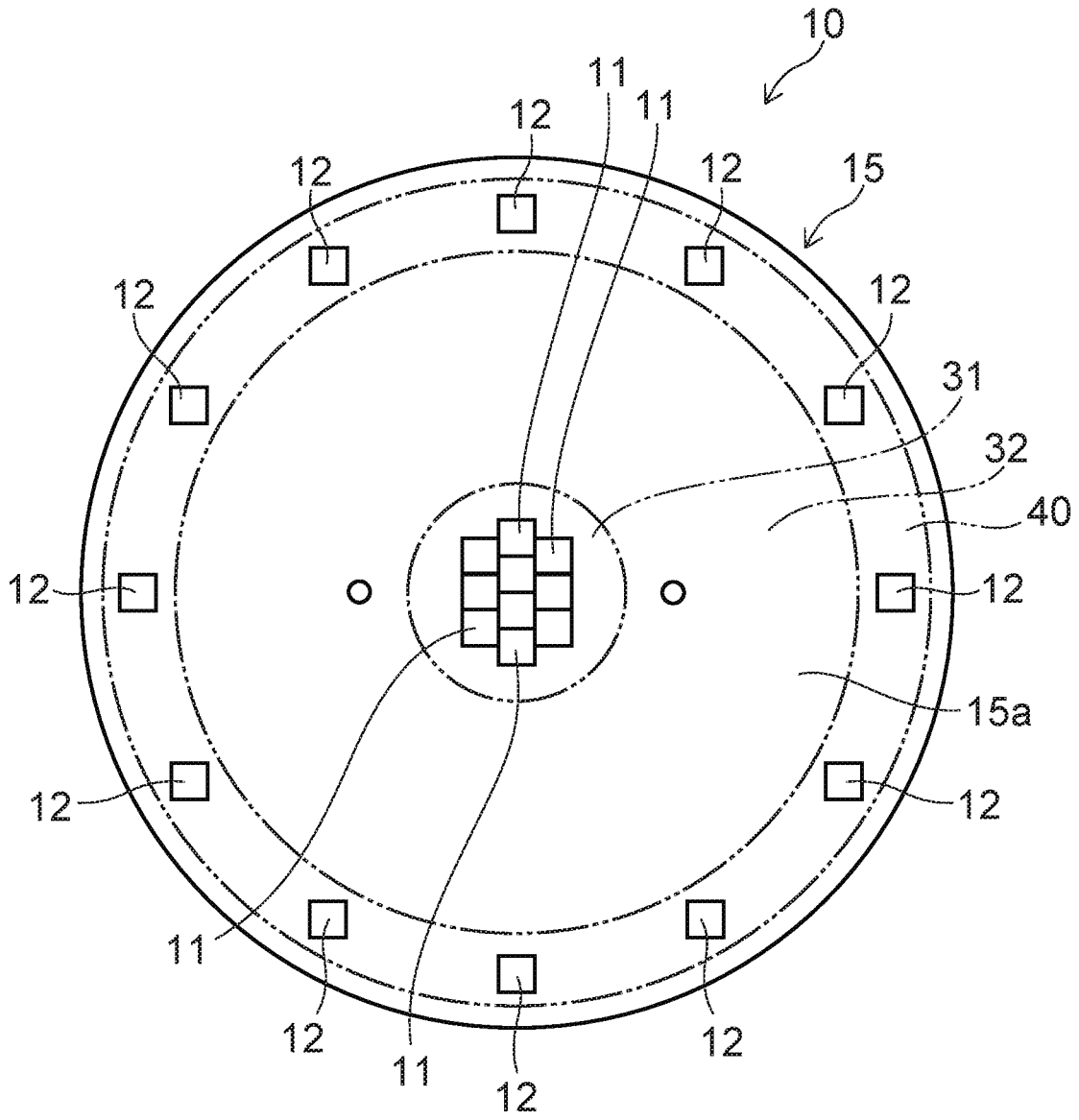
FIG. 2 is a bottom view showing the light source part of the first embodiment.

FIG. 2 is a bottom view showing the light source part 10 of the embodiment.

One wiring substrate 15 is provided in the light source part 10. Although the wiring substrate 15 has, for example, a substantially discal configuration, this is not limited thereto. In the wiring substrate 15, for example, wiring is provided inside a main material made of a resin material. The first light-emitting elements 11 and the second light-emitting elements 12 are mounted on a mounting surface 15*a* of the wiring substrate 15.

One or more, e.g., ten of the first light-emitting elements 11 are provided; and the first light-emitting elements 11 are disposed at the central vicinity of the wiring substrate 15. Two or more, e.g., twelve of the second light-emitting elements 12 are provided; and the second light-emitting elements 12 are disposed in a circular configuration in a region surrounding the ten first light-emitting elements 11. Here, although an example is shown in which the number of the first light-emitting elements 11 is ten and the number of the second light-emitting elements 12 is twelve, this is not limited thereto. Any number can be provided as long as one or more first light-emitting elements 11 are disposed at the central vicinity of the wiring substrate 15, and two or more second light-emitting elements 12 are disposed to surround the first light-emitting elements 11.

The first light-emitting elements 11 and the second light-emitting elements 12 are, for example, LEDs (Light Emitting Diodes). The first light-emitting elements 11 and the second light-emitting elements 12 can be controlled independently from each other. The color temperature of the light emitted from the first light-emitting element 11 may be the same as or different from the color temperature of the light emitted from the second light-emitting element 12.

Figure 3:
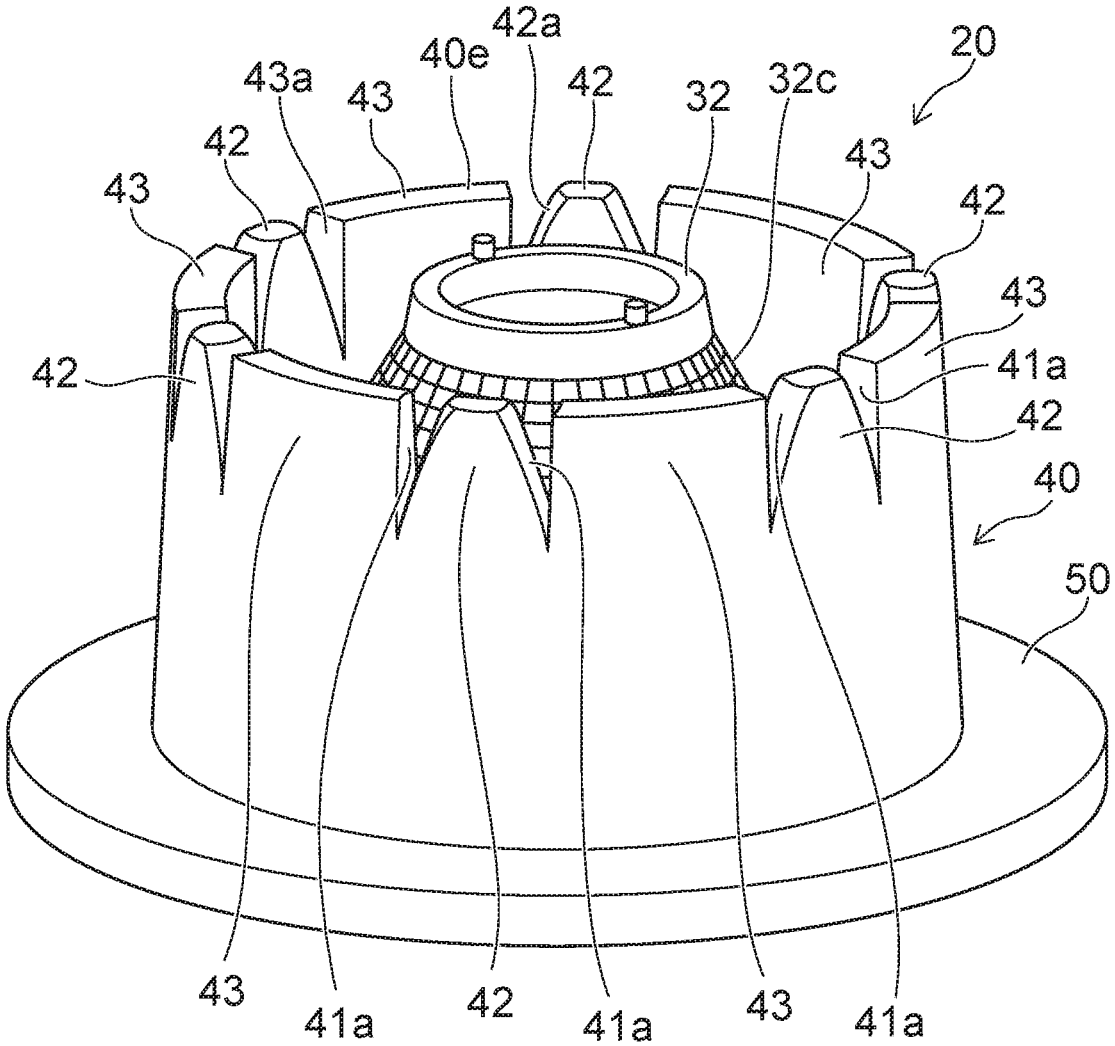
FIG. 3 and FIG. 4 are perspective views showing an optical member according to the first embodiment.
Figure 4:
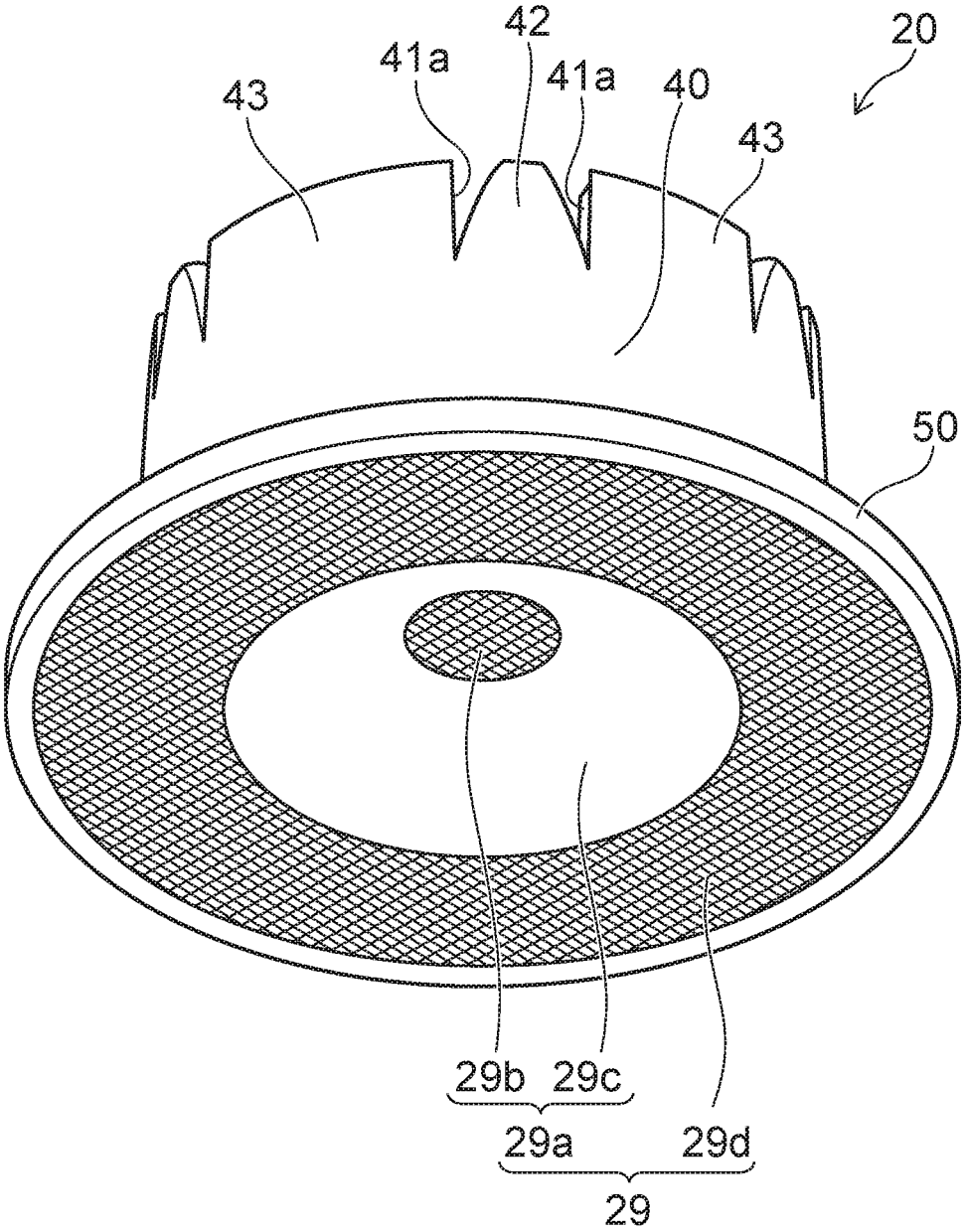

FIG. 3 and FIG. 4 are perspective views showing the optical member 20 according to the embodiment.

Figure 5:
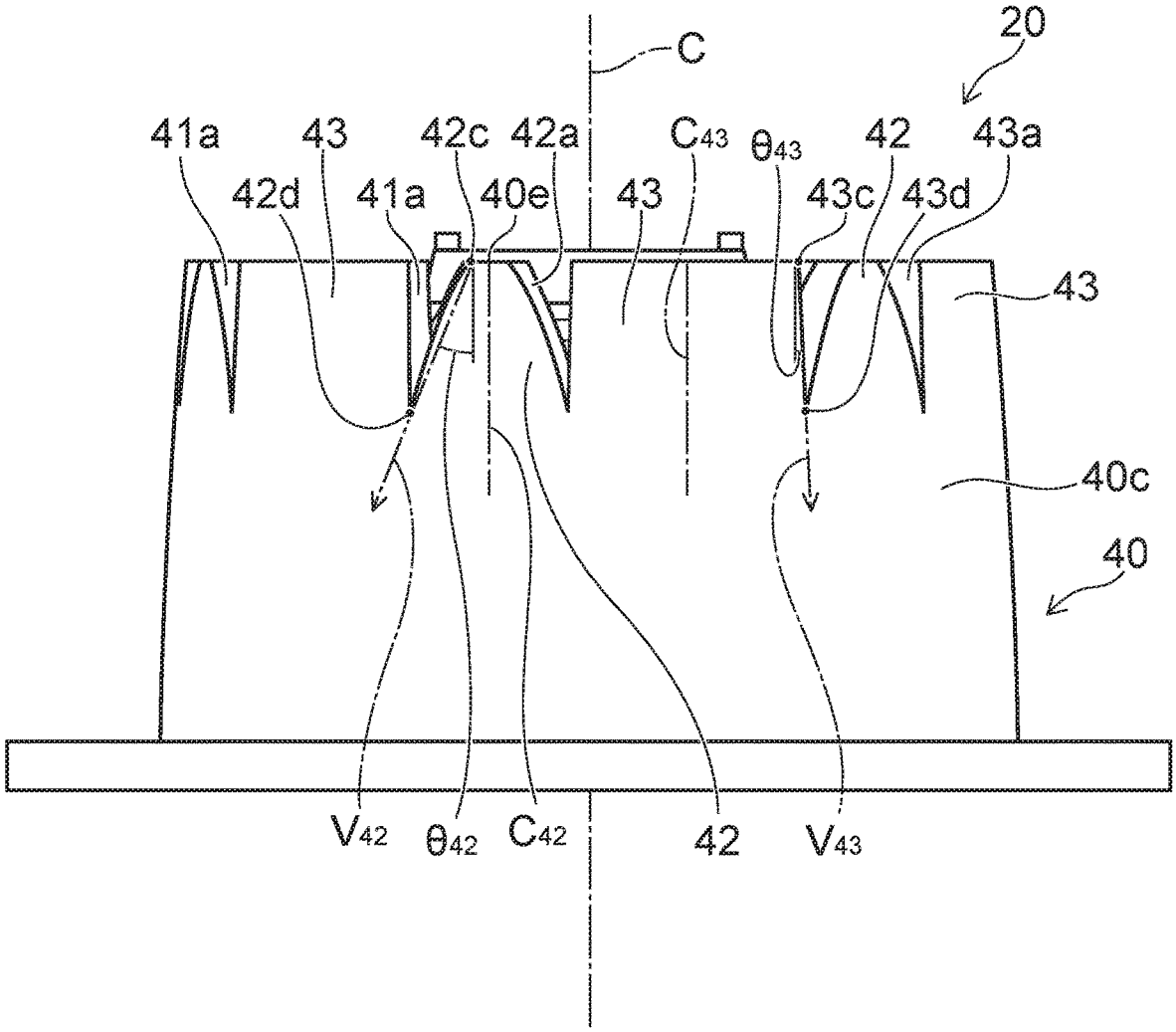
FIG. 5 is a side view showing the optical member according to the first embodiment.

FIG. 5 is a side view showing the optical member 20 according to the embodiment.

Figure 6:
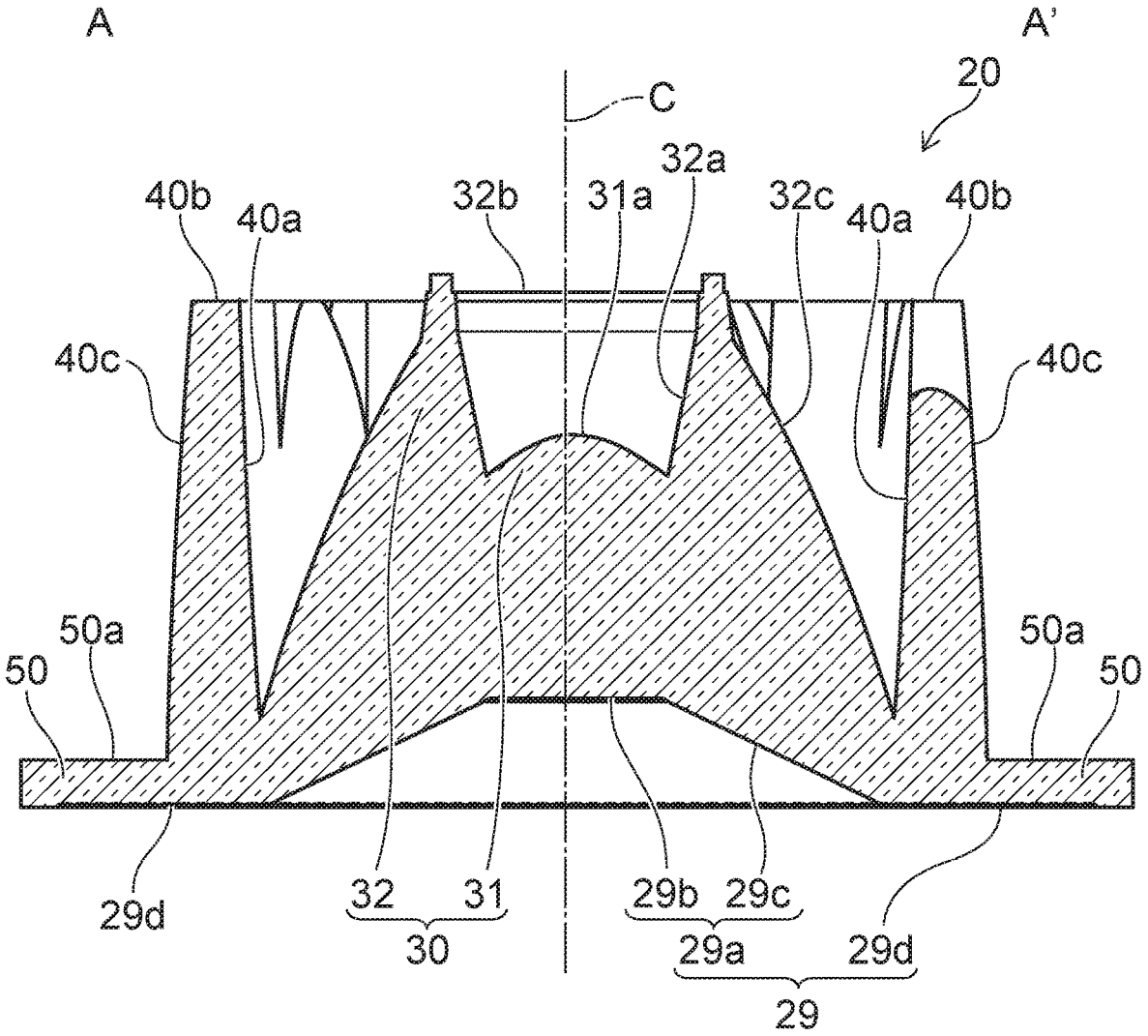
FIG. 6 is a cross-sectional view showing the optical member according to the first embodiment.

FIG. 6 is a cross-sectional view showing the optical member 20 according to the embodiment.

Figure 7:
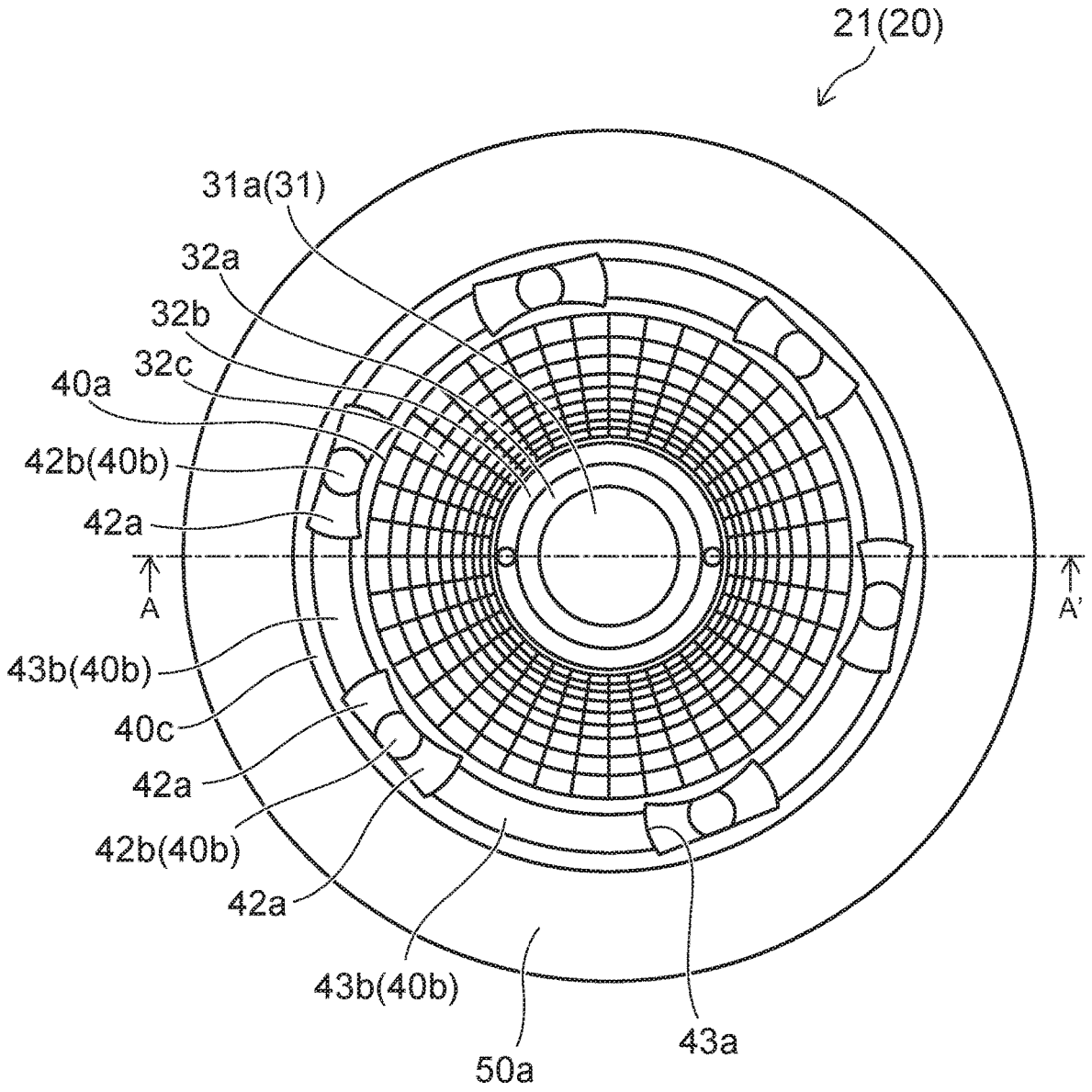
FIG. 7 is a top view showing the optical member according to the first embodiment.

FIG. 7 is a top view showing the optical member 20 according to the embodiment.

Figure 8:
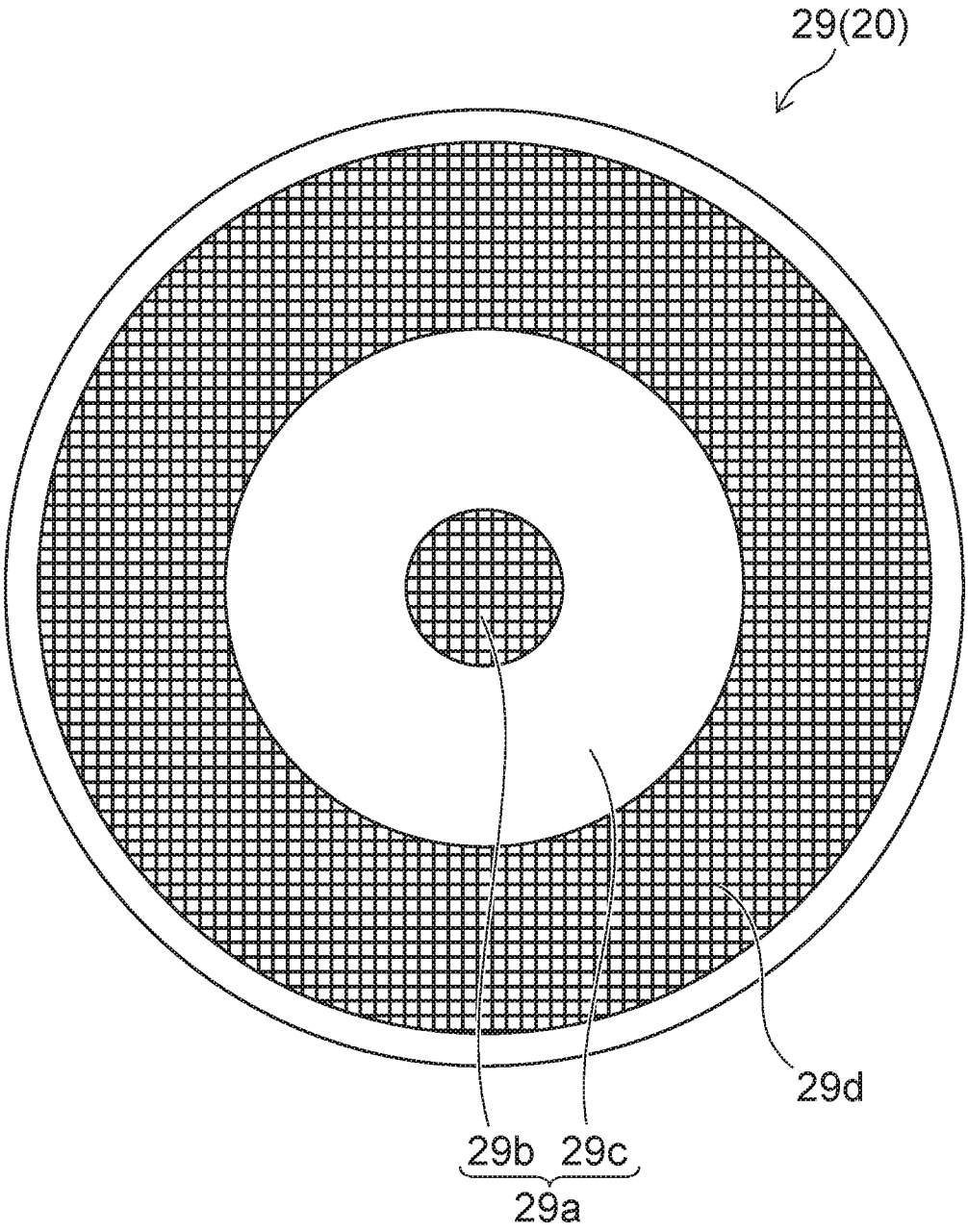
FIG. 8 is a bottom view showing the optical member according to the first embodiment.

FIG. 8 is a bottom view showing the optical member 20 according to the embodiment.

FIG. 6 shows a cross section along line A-A' shown in FIG. 7.

The optical member 20 is a transparent member formed to have a continuous body of a transparent material.

Accordingly, the entire optical member 20 is transparent. The configuration of the optical member 20 is generally a solid of revolution having a central axis C as a rotation axis; and the optical member 20 has a light incident surface 21 and a light-emitting surface 29. The light incident surface 21 opposes the light source part 10. As described below, unevennesses are formed in the light incident surface 21 and the light-emitting surface 29 of the optical member 20; and optical functions such as condensing, guiding, etc., are realized by the unevennesses.

A truncated circular conical recess 29*a* is formed at the central portion of the light-emitting surface 29. The inner surface of the recess 29*a* includes a bottom surface 29*b* and an oblique surface 29*c*. The periphery of the recess 29*a* of the light-emitting surface 29 is a planar portion 29*d* orthogonal to the central axis C. For example, surface texturing of the bottom surface 29*b* and the planar portion 29*d* is performed. In other words, fine unevennesses are formed in the bottom surface 29*b* and the planar portion 29*d*.

In the extension direction of the central axis C of the optical member 20 hereinbelow, the direction from the light-emitting surface 29 toward the light incident surface 21 is called the "light incident direction"; and the direction from the light incident surface 21 toward the light-emitting surface 29 is called the "light emission direction".

The concentrator 30 is provided at the central portion of the optical member 20. A convex lens 31 and a ring-shaped prism portion 32 surrounding the convex lens 31 are provided to have a continuous body in the concentrator 30. A convex surface 31*a* of the convex lens 31 faces the light incident direction. The surface of the convex lens 31 opposite to the convex surface 31*a* is the bottom surface 29*b* of the recess 29*a* of the light-emitting surface 29. The convex lens 31 is disposed at a position corresponding to the first light-emitting elements 11 of the light source part 10 and is disposed at, for example, a position opposing the first light-emitting elements 11.

The prism portion 32 has a substantially conical configuration in which the summit portion is caved-in. The prism portion 32 opposes a region of the light source part 10 between the first light-emitting elements 11 and the second light-emitting elements 12. The surface of the prism portion 32 facing the light incident direction includes an inner side surface 32*a*, an upper surface 32*b*, and an outer side surface 32*c*.

The inner side surface 32*a* of the prism portion 32 is in contact with the convex surface 31*a* of the convex lens 31 and is tilted away from the central axis C toward the light incident direction. The upper surface 32*b* is disposed at the periphery of the inner side surface 32*a* and is in contact with the inner side surface 32*a*. The upper surface 32*b* is a circular-ring shaped flat surface orthogonal to the central axis C.

The outer side surface 32*c* is disposed at the periphery of the upper surface 32*b* and is in contact with the upper surface 32*b*. The outer side surface 32*c* is tilted away from the central axis C toward the light emission direction. Also, the outer side surface 32*c* is curved to be convex outward with respect to the light-emitting surface 29, that is, toward the light incident direction. Faceting of the outer side surface 32*c* may be performed. Due to the faceting, the outer side surface 32*c* can include many tile-shaped flat surfaces, and can reduce the grainy appearance of the light-emitting elements by diffusing the light. The surface of the prism portion 32 facing the light emission direction is the oblique surface 29*c* of the recess 29*a* of the light-emitting surface 29.

The first tubular body 40 is provided at the periphery of the prism portion 32. The first tubular body 40 generally has a circular tubular configuration surrounding the prism portion 32. For example, the central axis of the first tubular body 40 is aligned with the central axis C of the optical member 20. The cross-sectional configuration of a surface of the first tubular body 40 including the central axis C is a substantially trapezoid. The surface of the first tubular body 40 facing the light incident direction includes an inner side surface 40*a*, an upper surface 40*b*, and an outer side surface 40*c*. The surface of the first tubular body 40 facing the light emission direction is the inner perimeter portion of the planar portion 29*d* of the light-emitting surface 29.

The inner side surface 40*a* of the first tubular body 40 is in contact with the outer side surface 32*c* of the prism portion 32, and is tilted away from the central axis C toward the light incident direction. The upper surface 40*b* is disposed at the periphery of the inner side surface 40*a* and is in contact with the inner side surface 40*a*. The upper surface 40*b* is a circular-ring shaped flat surface orthogonal to the central axis C. The outer side surface 40*c* is disposed at the periphery of the upper surface 40*b* and is in contact with the upper surface 40*b*. The outer side surface 40*c* may be parallel to the central axis C or may be tilted in a direction away from the central axis C toward the light emission direction.

The multiple recesses 41*a* are formed in an end portion 40*e* of the first tubular body 40 on the light incident-direction side, i.e., the end portion 40*e* including the upper surface 40*b*. The portions of the first tubular body 40 between the recesses 41*a* are the first light guide portion 42 or the second light guide portion 43. Hereinbelow, the first light guide portion 42 and the second light guide portion 43 also are generally referred to as simply the "light guide portion".

The first light guide portion 42 has a pair of side surfaces 42*a* facing the circumferential direction of the first tubular body 40, and an upper surface 42*b* between the pair of side surfaces 42*a*. The second light guide portion 43 has a pair of side surfaces 43*a* facing the circumferential direction of the first tubular body 40; and an upper surface 43*b* is between the pair of side surfaces 43*a*. The side surface 42*a* of the light guide portion is curved to be convex toward the recess 41*a*. The side surface 43*a* of the light guide portion may be curved to be convex toward the recess 41*a* or may be a plane parallel to the central axis C. The upper surface 42*b* of the first light guide portion 42 and the upper surface 43*b* of the second light guide portion 43 are portions of the upper surface 40*b* of the first tubular body 40.

The first light guide portion 42 and the second light guide portion 43 are arranged alternately along the circumferential direction of the first tubular body 40 in the first tubular body 40. Therefore, one inner side surface of the recess 41*a* is the side surface 42*a* of the first light guide portion 42; and the other inner side surface of the recess 41*a* is the side surface 43*a* of the second light guide portion 43.

The recess 41*a* is narrower or constant away from the end portion 40*e*. Accordingly, the light guide portion is wider or constant away from the end portion 40*e* of the first tubular body 40. In the embodiment, the light guide portion is wider away from the end portion 40*e*. However, the proportion of becoming wider, i.e., the degree of the tilt with respect to the central axis C, is different between the side surfaces 42*a* and 43*a*; and the side surface 42*a* of the first light guide portion 42 is tilted more than the side surface 43*a* of the second light guide portion 43 with respect to the central axis C.

Describing in more detail, at the outer side surface 40*c* of the first tubular body 40, a direction $V_{42}$ from an intersection 42*c* between the side surface 42*a* of the first light guide portion 42 and the end portion 40*e* of the first tubular body 40 toward a point 42*d* of the side surface 42*a* of the first light guide portion 42 most distal to the end portion 40*e* is tilted at a first angle $\theta_{42}$ with respect to the extension direction of a central axis $C_{42}$ of the first light guide portion 42. Also, at the outer side surface 40*c* of the first tubular body 40, a direction $V_{43}$ from an intersection 43*c* between the side surface 43*a* of the second light guide portion 43 and the end portion 40*e* of the first tubular body 40 toward a point 43*d* of the side surface 43*a* of the second light guide portion 43 most distal to the end portion 40*e* is tilted at a second angle $\theta_{43}$ with respect to the extension direction of a central axis $C_{43}$ of the second light guide portion 43. The first angle $\theta_{42}$ is larger than the second angle $\theta_{43}$.

The second light-emitting elements 12 of the light source part 10 are disposed at positions corresponding to the first light guide portions 42 and the second light guide portions 43, e.g., positions opposing the upper surfaces 42*b* of the first light guide portions 42 and positions opposing the upper surfaces 43*b* of the second light guide portions 43. The second light-emitting elements 12 that are disposed at the positions corresponding to the first light guide portions 42 and the second light-emitting elements 12 that are disposed at the positions corresponding to the second light guide portions 43 can be controlled independently from each other. The color temperature of the light emitted from the second light-emitting element 12 disposed at the position corresponding to the first light guide portion 42 may be the same as or different from the color temperature of the light emitted from the second light-emitting element 12 disposed at the position corresponding to the second light guide portion 43.

A flat plate portion 50 is provided at the periphery of the first tubular body 40. It is sufficient for the flat plate portion 50 to have a configuration surrounding the periphery of the first tubular body 40, and favorable to have a circular ring plate configuration. An upper surface 50*a* of the flat plate portion 50 is, for example, a plane orthogonal to the central axis C. The surface of the flat plate portion 50 facing the light emission direction is the outer perimeter portion of the planar portion 29*d* of the light-emitting surface 29.

The light incident surface 21 of the optical member 20 includes the convex surface 31*a* of the convex lens 31, the inner side surface 32*a*, the upper surface 32*b*, and the outer side surface 32*c* of the prism portion 32, the inner side surface 40*a*, the upper surface 40*b*, the side surface 42*a*, the side surface 43*a*, and the outer side surface 40*c* of the first tubular body 40, and the upper surface 50*a* of the flat plate portion 50. Among these surfaces, for example, processing such as faceting or the like to diffuse the light is performed on the outer side surface 32*c* of the prism portion 32. The light-emitting surface 29 of the optical member 20 includes the bottom surface 29*b*, the oblique surface 29*c*, and the planar portion 29*d* of the recess 29*a*. Among these components, for example, processing such as surface texturing or the like to diffuse the light is performed on the bottom surface 29*b* and the planar portion 29*d*.

The entire light incident surface 21 is disposed at positions and angles that can be viewed directly from the light emission direction. Thereby, the optical member 20 can be made by injection molding, etc. For example, the optical member 20 can be molded by pouring a transparent resin into a mold open on the light-emitting surface 29 side, curing the transparent resin, and withdrawing the transparent resin in the light emission direction.

The cover member 80 includes, for example, an inner tubular portion 81 that surrounds the light source part 10 and the optical member 20, and an outer tubular portion 82 that is mounted to one end portion of the inner tubular portion 81 and supports the optical member 20 with the inner tubular portion 81. For example, the inner tubular portion 81 and the outer tubular portion 82 of the cover member 80 have circular tubular configurations. For example, the inner tubular portion 81 and the outer tubular portion 82 are formed of resin materials. For example, the inner tubular portion 81 is fixed to the ceiling of the room. A ring-shaped protrusion 82*a* is formed at the inner surface of the outer tubular portion 82; and the outer tubular portion 82 is fixed with respect to the inner tubular portion 81 by the end portion of the inner tubular portion 81 butting against the protrusion 82*a*. The light source part 10 and the optical member 20 are supported by the cover member 80. The light that is emitted from the optical member 20 undergoes specular reflection when the inner surfaces of the inner tubular portion 81 and the outer tubular portion 82 are mirror surfaces, is diffusely reflected when the inner surfaces are white, and is absorbed when the inner surfaces are dark-colored.

Operations of the light-emitting device 1 according to the embodiment will now be described.

Figure 9A:
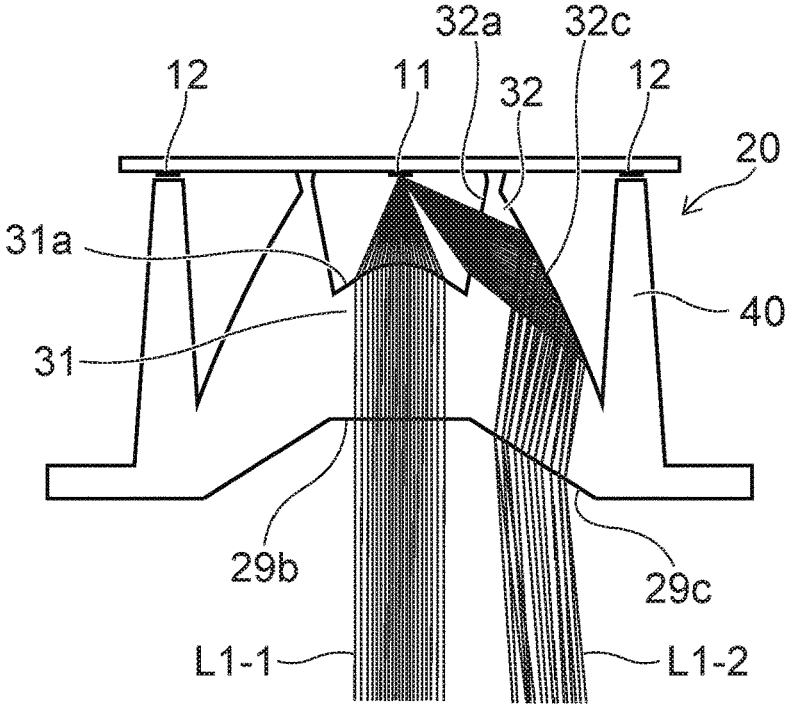
FIG. 9A shows simulation results of trajectories of light emitted from a first light-emitting element.

FIG. 9A shows simulation results of trajectories of the light emitted from the first light-emitting element 11.

Figure 9B:
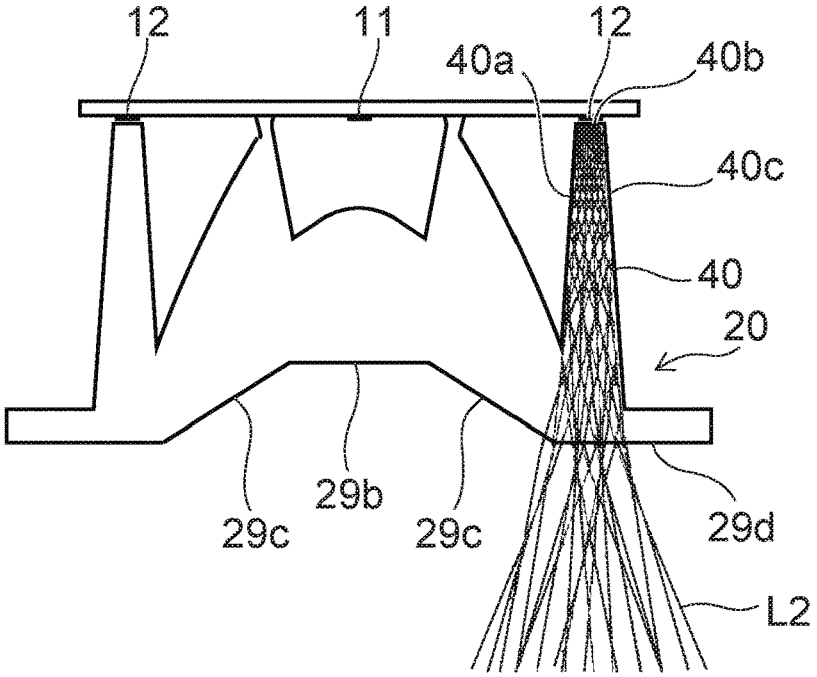
FIG. 9B, FIG. 10A, and FIG. 10B show simulation results of trajectories of light emitted from a second light-emitting element.
Figure 10A:
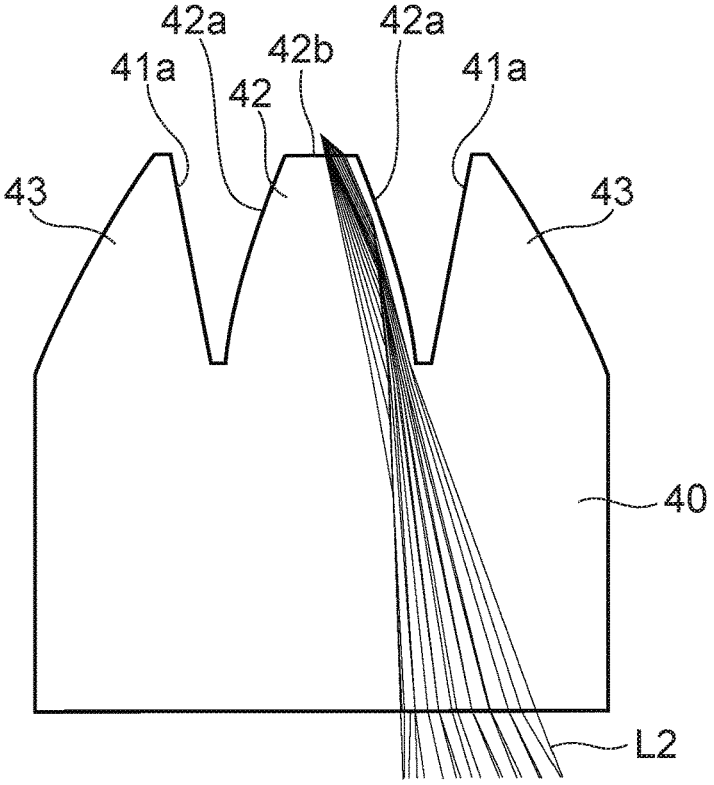
Figure 10B:
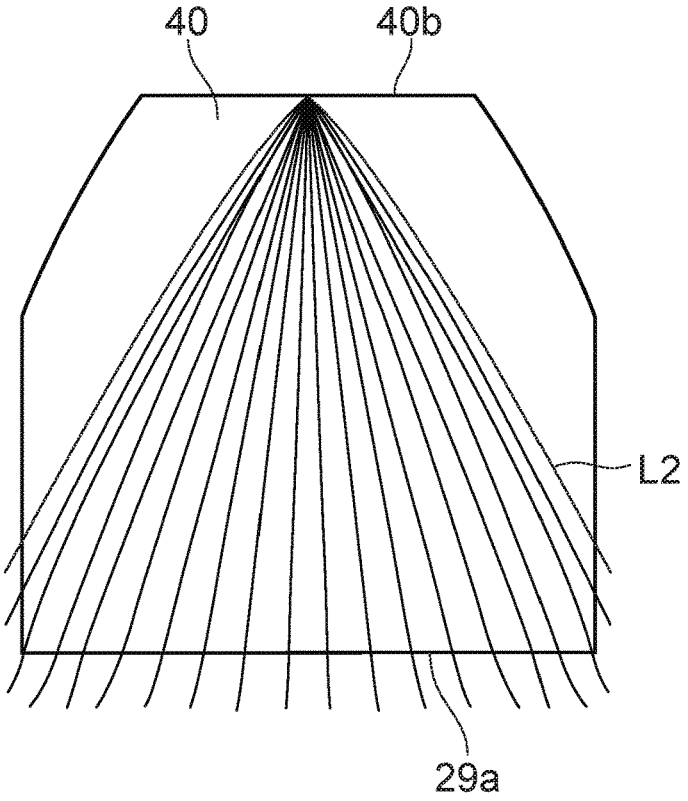

FIG. 9B, FIG. 10A, and FIG. 10B show simulation results of the trajectories of the light emitted from the second light-emitting element 12.

FIG. 9A shows a cross section including the central axis C, and shows the light passing through the concentrator 30. FIG. 9B shows a cross section including the central axis C, and shows the light passing through the light guide portion. FIG. 10A is a drawing of the optical member 20 when viewed from the side, and shows the light passing through the light guide portion. FIG. 10B is a drawing of the optical member 20 when viewed from the side, and shows the case where the recess 41*a* is not provided in the first tubular body 40.

When the first light-emitting element 11 is ON, a portion of the light emitted from the first light-emitting element 11 is incident on the convex surface 31*a* of the convex lens 31 of the optical member 20. Hereinbelow, the light that is incident on the convex lens 31 is called "light L1-1". The light L1-1 passes through the convex lens 31, is condensed by the convex lens 31, and is emitted from the bottom surface 29*b* of the recess 29*a* of the light-emitting surface 29. In the case where surface texturing of the bottom surface 29*b* is performed, the light L1-1 is diffused when passing through the bottom surface 29*b*.

The remainder of the light emitted from the first light-emitting element 11, i.e., the greater part of the light emitted from the first light-emitting element 11 but not incident on the convex lens 31, is incident on the inner side surface 32*a* of the prism portion 32. Hereinbelow, the light that is incident on the prism portion 32 is called "light L1-2". The light L1-2 passes through the prism portion 32, and is emitted from the oblique surface 29*c* of the light-emitting surface 29 after least a portion of the light L1-2 undergoes total internal reflection at the outer side surface 32*c*. Because the outer side surface 32*c* of the prism portion 32 is curved to be convex outward, the light L1-2 is condensed by undergoing total internal reflection at the outer side surface 32*c*. Also, in the case where faceting of the outer side surface 32*c* is performed, the light L1-2 is diffused when undergoing total internal reflection at the outer side surface 32*c*. The light L1-1 and the light L1-2 are generally referred to as the "light L1". A full width at half maximum (hereinafter referred to as "FWHM") $\theta_{HW1}$ of the light L1 is, for example, 21°.

When the second light-emitting element 12 is ON, the greater part of the light emitted from the second light-emitting element 12 is incident on the upper surface 40*b* of the first tubular body 40 of the optical member 20. Hereinbelow, the light that is incident on the first tubular body 40 is called "light L2".

In the thickness direction of the first tubular body 40, at least a portion of the light L2 is guided through the interior of the first tubular body 40 by repeating total internal reflection at the inner side surface 40*a* and the outer side surface 40*c* of the first tubular body 40, and is diffused and emitted from the planar portion 29*d* of the light-emitting surface 29.

In the circumferential direction of the first tubular body 40, a portion of the light L2 passes through the light guide portion and reaches the side surface (e.g., the side surface 42*a* of the first light guide portion 42). Of the light L2 reaching the side surface, the greater part undergoes total internal reflection, again passes through the light guide portion, and is emitted from the light-emitting surface 29. The remainder of the light L2 reaches the light-emitting surface 29 without reaching the side surface of the light guide portion, and is emitted from the light-emitting surface 29.

At this time, the degree of the diffusion of the light L2 is different according to the configuration of the light guide portion, e.g., the depth of the recess 41*a*, the tilt angle of the side surface of the light guide portion with respect to the central axis C, and the state of the curve of the side surface of the light guide portion. Generally, a FWHM $\theta_{HW2}$ of the light L2 decreases as the recess 41*a* deepens. Also, the FWHM $\theta_{HW2}$ of the light L2 decreases as the tilt angle of the side surface of the light guide portion increases. The FWHM $\theta_{HW2}$ of the light L2 is adjustable in a range of, for example, not less than 30° and not more than 70°.

In the case where the recess 41*a* is not formed in the first tubular body 40, that is, in the case where the light guide portion having the side surface facing the circumferential direction of the first tubular body 40 does not exist, the light L2 does not undergo total internal reflection at the side surface of the light guide portion; therefore, compared to the case where the recess 41*a* is formed, the FWHM $\theta_{HW2}$ of the light L2 increases. In such a case, the FWHM $\theta_{HW2}$ is, for example, 71°.

Figure 11:
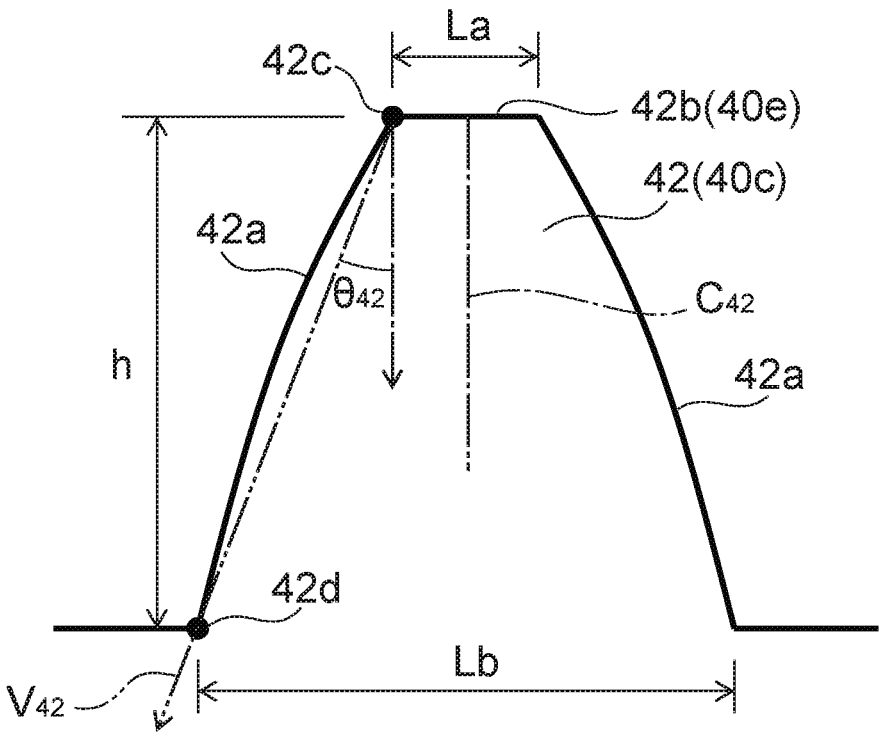
FIG. 11 is a projection view showing a first light guide portion of the optical member according to the first embodiment.

FIG. 11 is a projection view showing the first light guide portion 42 of the optical member 20 according to the embodiment.

In FIG. 11, the first light guide portion 42, which originally is curved along the outer perimeter of the first tubular body 40, is projected onto a plane.

For example, in the first light guide portion 42 as described above, the first angle $\theta_{42}$ is set as an angle between the direction $V_{42}$ and the extension direction of the central axis $C_{42}$ of the first light guide portion 42 at the outer side surface 40*c* of the first tubular body 40. The direction $V_{42}$ is the direction from the intersection 42*c* toward the point 42*d*. The intersection 42*c* is the intersection between the side surface 42*a* of the first light guide portion 42 and the end portion 40*e* of the first tubular body 40, i.e., the upper surface 42*b*. The point 42*d* is the point of the side surface 42*a* of the first light guide portion 42 most distal to the end portion 40*e*.

On the other hand, at the outer side surface 40*c* of the first tubular body 40, the first angle $\theta_{42}$ can be calculated substantially by the following Formula 1; and for the circumferential direction of the first tubular body 40, La is the length of the upper surface 42*b* of the first light guide portion 42, Lb is the length of the base portion of the first light guide portion 42, i.e., the portion most distal to the upper surface 42*b*, and h is the height of the first light guide portion 42.

$$\theta_{42} = \tan^{-1}\left(\frac{Lb - La}{2h}\right) \quad \text{[Formula 1]}$$

From simulations of different configurations of the light guide portion, the FWHM of the light L2 can be adjusted in the range of 31° to 71° as shown in Table 1.

TABLE 1

| TEST EXAMPLE No. | LIGHT-EMITTING ELEMENT SWITCHED ON | LENGTH La (mm) | LENGTH Lb (mm) | HEIGHT h (mm) | ANGLE θ (°) | FWHM (°) |
|---|---|---|---|---|---|---|
| 1 | FIRST LIGHT-EMITTING ELEMENT 11 | — | — | — | — | 21 |
| 2 | SECOND LIGHT-EMITTING ELEMENT 12 | 2.74 | 10.00 | 16.51 | 12.40 | 31 |
| 3 | SECOND LIGHT-EMITTING ELEMENT 12 | 3.74 | 10.00 | 9.07 | 19.04 | 39 |
| 4 | SECOND LIGHT-EMITTING ELEMENT 12 | 3.96 | 10.00 | 7.27 | 22.56 | 50 |
| 5 | SECOND LIGHT-EMITTING ELEMENT 12 | | NO RECESS 41a | | | 71 |

Figure 12A:
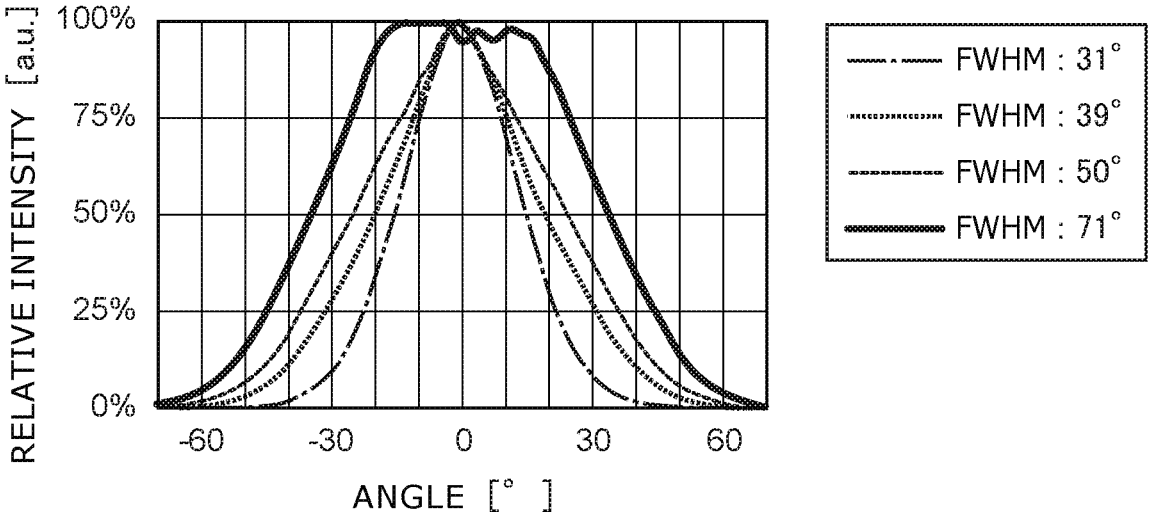
FIG. 12A is a graph showing elative light distribution of a light emitted from a first tubular body, in which the horizontal axis is an angle, and the vertical axis is relative intensity.

FIG. 12A is a graph showing the relative light distribution of the light L2 emitted from the first tubular body 40, in which the horizontal axis is the angle, and the vertical axis is the relative intensity.

Figure 12B:
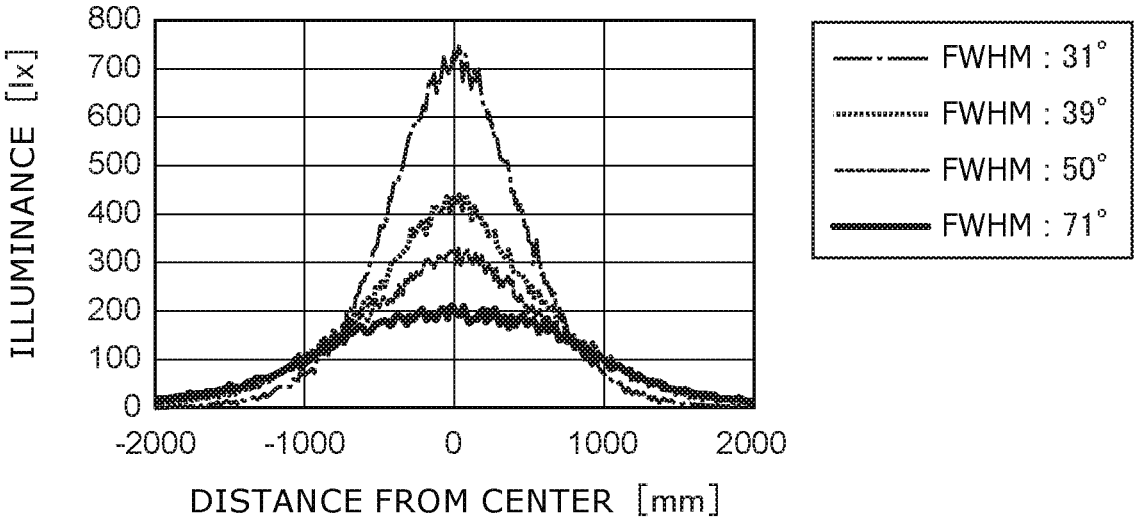
FIG. 12B is a graph showing the illuminance distribution of the light emitted from the first tubular body, in which the horizontal axis is distance from a center at irradiation surface, and the vertical axis is illuminance.

FIG. 12B is a graph showing the illuminance distribution of the light L2 emitted from the first tubular body 40, in which the horizontal axis is the distance from the center at the irradiation surface, and the vertical axis is the illuminance.

By adjusting the configuration of the light guide portion, a good light distribution and illuminance distribution can be obtained by changing the FWHM (the light distribution angle).

Also, by respectively setting the values of the length La, the length Lb, and the height h to satisfy the following conditions (1) to (4), manufacturing is even easier; and the light-emitting device can be suited to actual use.

(1) La<Lb (2) 1 mm<La<12 mm, 3.5 mm<Lb<30 mm, and 5 mm<h<49.5 mm (3) La is not less than 0.25 times and not more than 0.4 times Lb.

(4) h is not less than 0.7 times and not more than 1.65 times Lb.

Simulations were performed in which the second light-emitting element 12 was switched ON, and different configurations of the light guide portion were given values satisfying the conditions (1) to (4) recited above. As a result, as shown in Table 2, it was possible to adjust the FWHM of the light L2 in the range of 28° to 58°.

TABLE 2

| TEST EXAMPLE No. | LENGTH La (mm) | LENGTH Lb (mm) | HEIGHT h (mm) | FWHM (°) |
|---|---|---|---|---|
| 11 | 1.00 | 3.50 | 5.00 | 36 |
| 12 | 1.00 | 3.50 | 5.78 | 34 |
| 13 | 1.40 | 3.50 | 5.00 | 35 |
| 14 | 1.40 | 3.50 | 5.78 | 33 |
| 15 | 4.19 | 16.75 | 11.73 | 53 |
| 16 | 4.19 | 16.75 | 27.64 | 30 |
| 17 | 6.70 | 16.75 | 11.73 | 51 |
| 18 | 6.70 | 16.75 | 27.64 | 46 |
| 19 | 7.50 | 30.00 | 21.00 | 55 |
| 20 | 7.50 | 30.00 | 49.50 | 28 |
| 21 | 12.00 | 30.00 | 21.00 | 53 |
| 22 | 12.00 | 30.00 | 49.50 | 44 |

Thus, according to the embodiment, different light distribution angles can be realized by using different configurations of the light guide portion. In the lighting device 100 according to the embodiment, two levels of light distribution angles can be realized by the second light-emitting element 12 and the first tubular body 40 by setting the configuration of the first light guide portion 42 and the configuration of the second light guide portion 43 to be different in the optical member 20. Also, by combining with the first light-emitting element 11 and the concentrator 30, a total of three levels of light distribution angles can be realized.

The light distribution angle can be switched by selecting the light-emitting elements that are switched ON among the first light-emitting elements 11 and the second light-emitting elements 12. For example, the light distribution angle can be a "narrow angle" by switching ON only the first light-emitting elements 11; the light distribution angle can be an "intermediate angle" by switching ON only the second light-emitting elements 12 disposed at the positions corresponding to the first light guide portions 42; and the light distribution angle can be a "wide angle" by switching ON only the second light-emitting elements 12 disposed at the positions corresponding to the second light guide portions 43.

Effects of the embodiment will now be described.

In the lighting device 100, the light distribution angle can be switched by electrical means without providing mechanical means. Therefore, downsizing and a lower cost of the lighting device 100 can be realized. Because there is no mechanical operation, the switching time is unnecessary; noise is not generated; and the reliability is high. The external appearance of the lighting device 100 does not suggest that switching of the light distribution angle is possible; therefore, when mounted to the ceiling of a room and used as a downlight, etc., the interior-stylishness can be improved.

The cost of the lighting device 100 can be reduced even more because the three levels of light distribution angles can be realized using one optical member 20. As described above, the cost can be reduced further by forming the optical member 20 by using injection molding, etc. When viewed by the user, the apparent discontinuity when switching between the light distribution angles is low because the position and the surface area of the light-emitting region substantially do not change when switching.

In the case where faceting of the outer side surface 32*c* of the prism portion 32 is performed, and surface texturing of the bottom surface 29*b* and the planar portion 29*d* of the light-emitting surface 29 of the optical member 20 is performed, the light that is emitted from the first light-emitting elements 11 and the second light-emitting elements 12 is diffused. As a result, when viewed by the user, the grainy appearance of the light-emitting region can be reduced; and the glare can be suppressed.

The first light-emitting element 11 and the second light-emitting element 12 may be switched ON simultaneously. Thereby, for example, a work space such as a desk, etc., can be illuminated to be brighter by the first light-emitting element 11 while illuminating the entire room by the second light-emitting element 12. In such a case, the color temperature of the light emitted by the first light-emitting element 11 and the color temperature of the light emitted by the second light-emitting element 12 may be different from each other. For example, the desk top may be illuminated with white light by setting the color temperature of the light emitted from the first light-emitting element 11 to 6500 K (Kelvin) while illuminating the entire room with lamp light by setting the color temperature of the light emitted from the second light-emitting element 12 to 2700 K.

The light distribution angles may be switched by using a sensor to detect a human. For example, the entire room may be illuminated by switching ON only the second light-emitting element 12 when a human is not at the vicinity of a work space such as a desk, etc.; or the work space also may be illuminated by switching ON both the first light-emitting element 11 and the second light-emitting element 12 when the human is in the work space. Or, for example, both the first light-emitting element 11 and the second light-emitting element 12 may be switched OFF when the room is unoccupied; only the first light-emitting element 11 may be switched ON to illuminate only the entrance vicinity locally when a human appears at the entrance of the room; and when the human enters the room, the entire room may be illuminated by switching ON the second light-emitting element 12.

Second Embodiment

A second embodiment will now be described.

Figure 13:
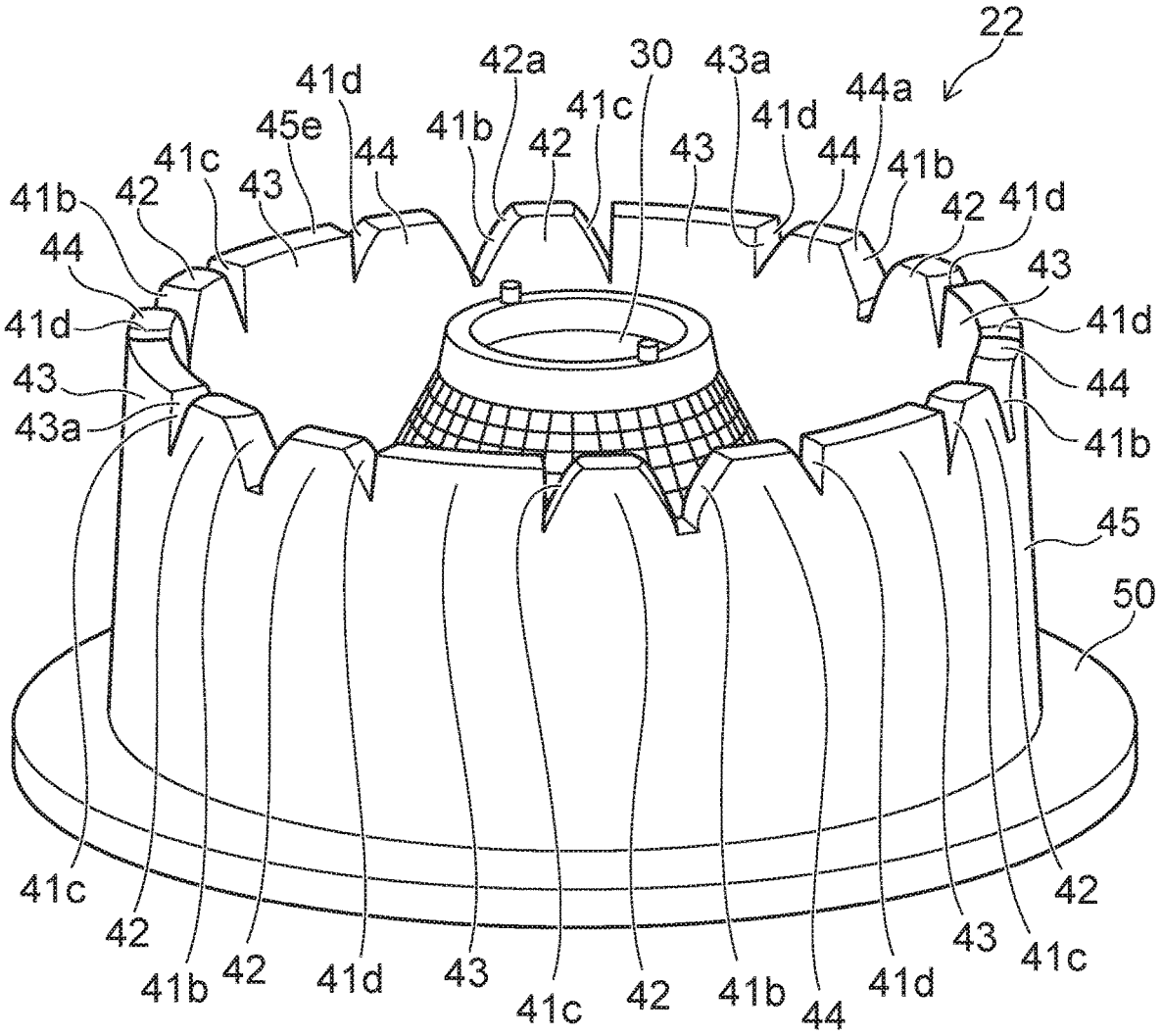
FIG. 13 and FIG. 14 are perspective views showing an optical member according to a second embodiment.
Figure 14:
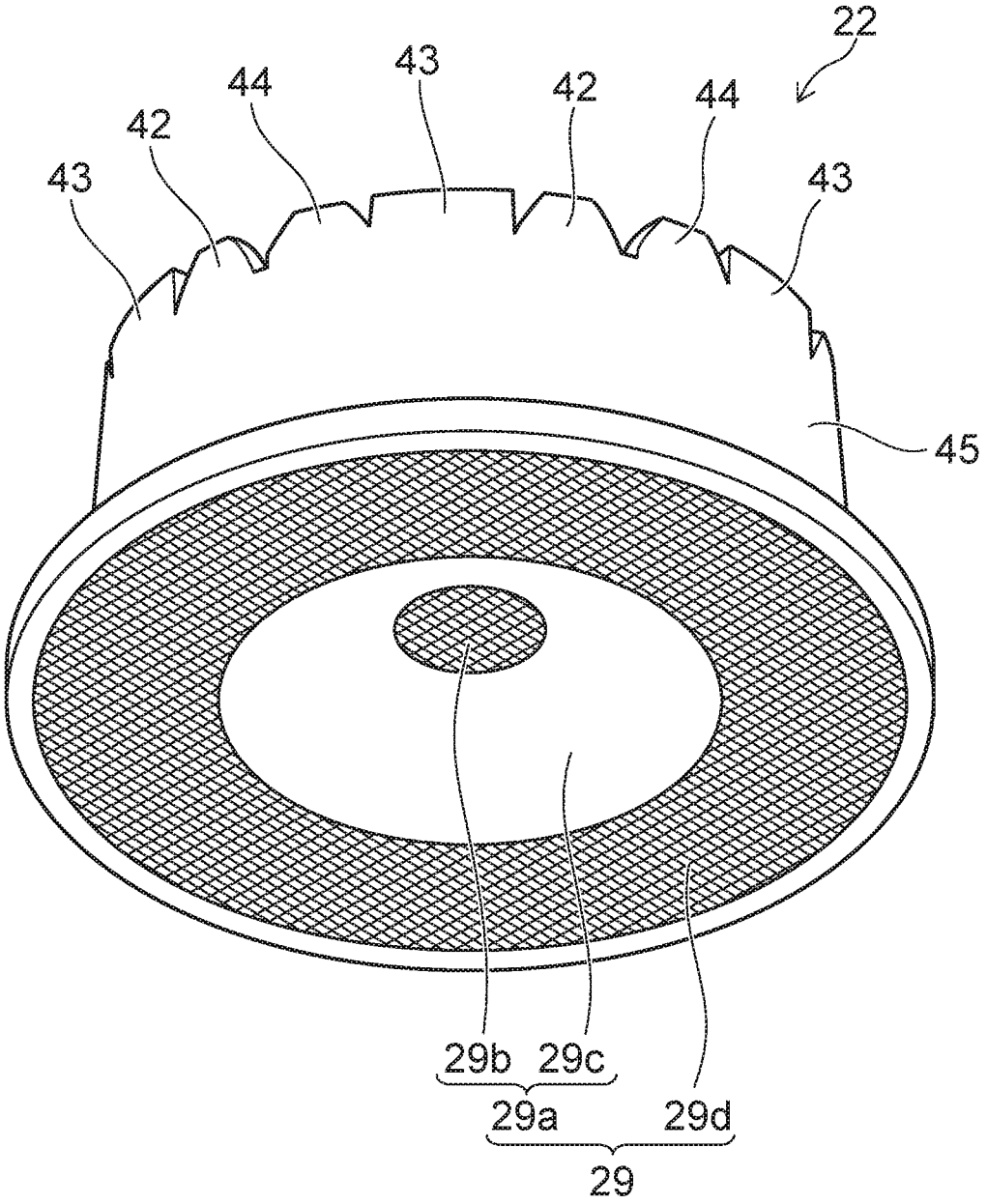

FIG. 13 and FIG. 14 are perspective views showing an optical member 22 according to the embodiment.

Figure 15:
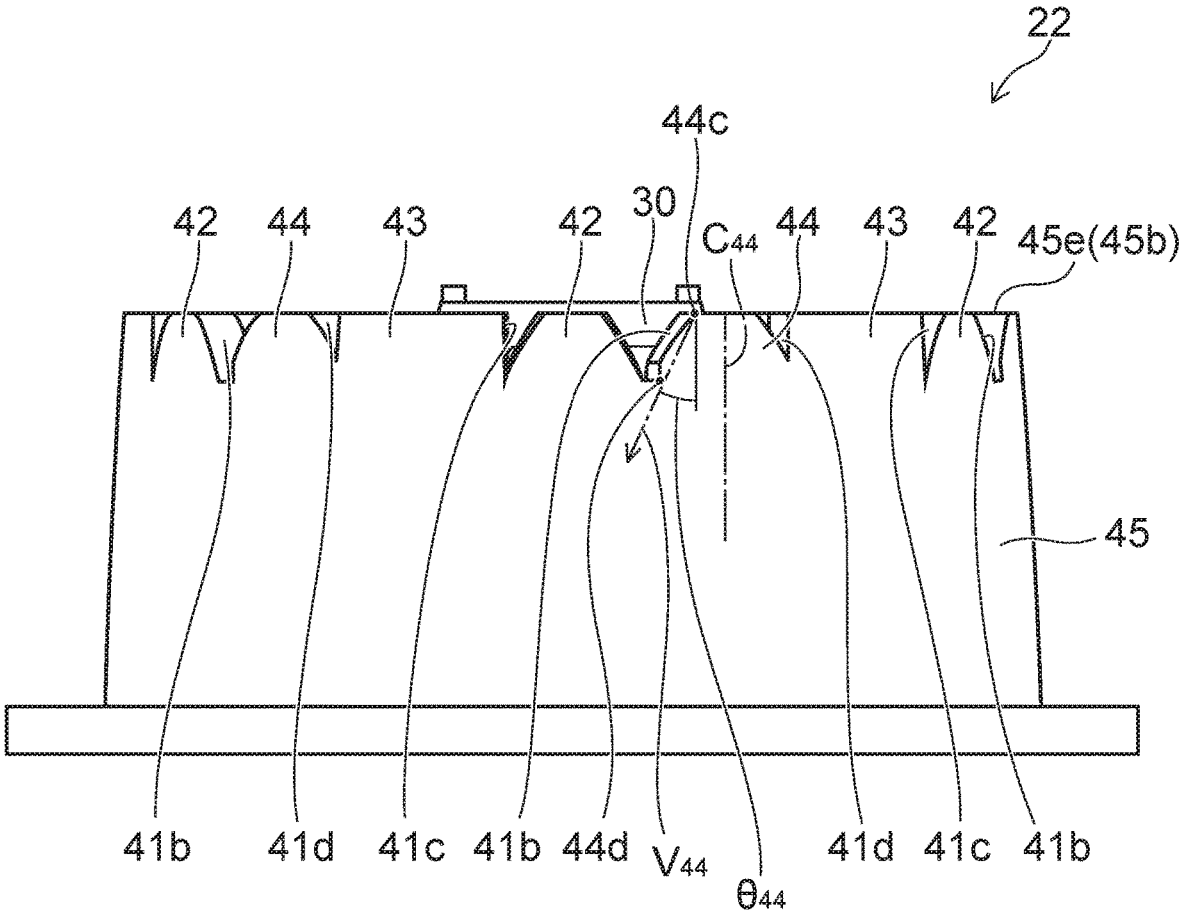
FIG. 15 is a side view showing the optical member according to the second embodiment.

FIG. 15 is a side view showing the optical member 22 according to the embodiment.

Figure 16:
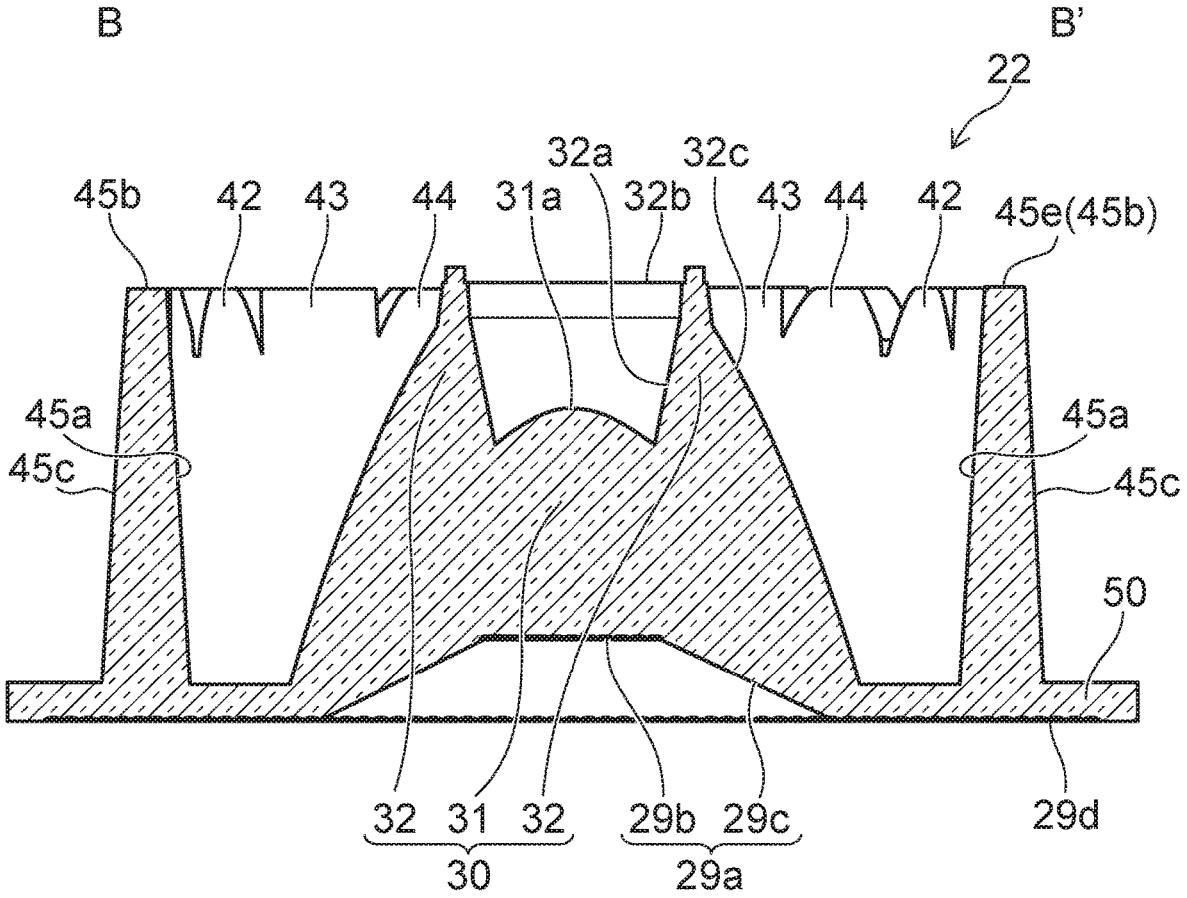
FIG. 16 is a cross-sectional view showing the optical member according to the second embodiment.

FIG. 16 is a cross-sectional view showing the optical member 22 according to the embodiment.

Figure 17:
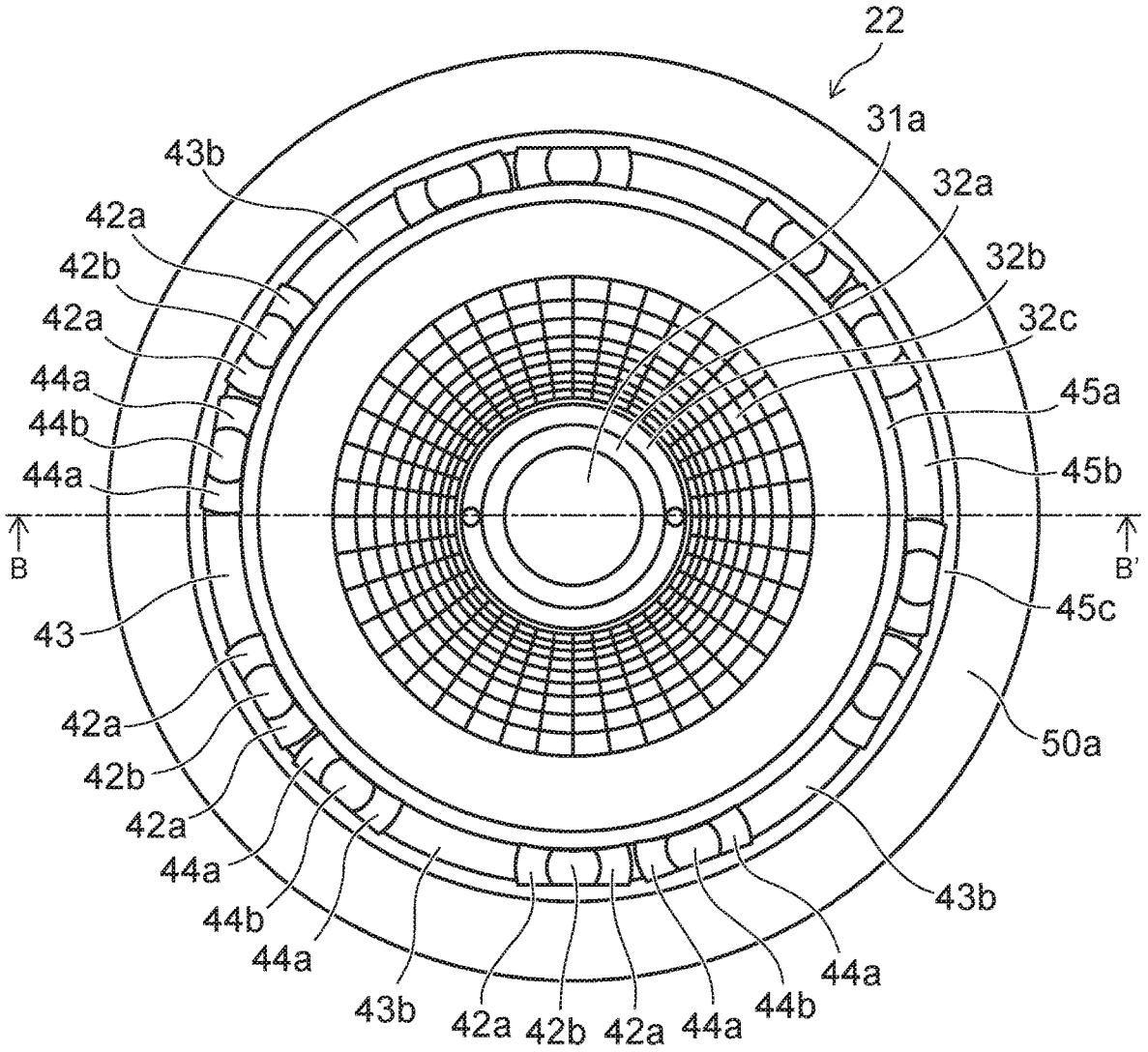
FIG. 17 is a top view showing the optical member according to the second embodiment.

FIG. 17 is a top view showing the optical member 22 according to the embodiment.

Figure 18:
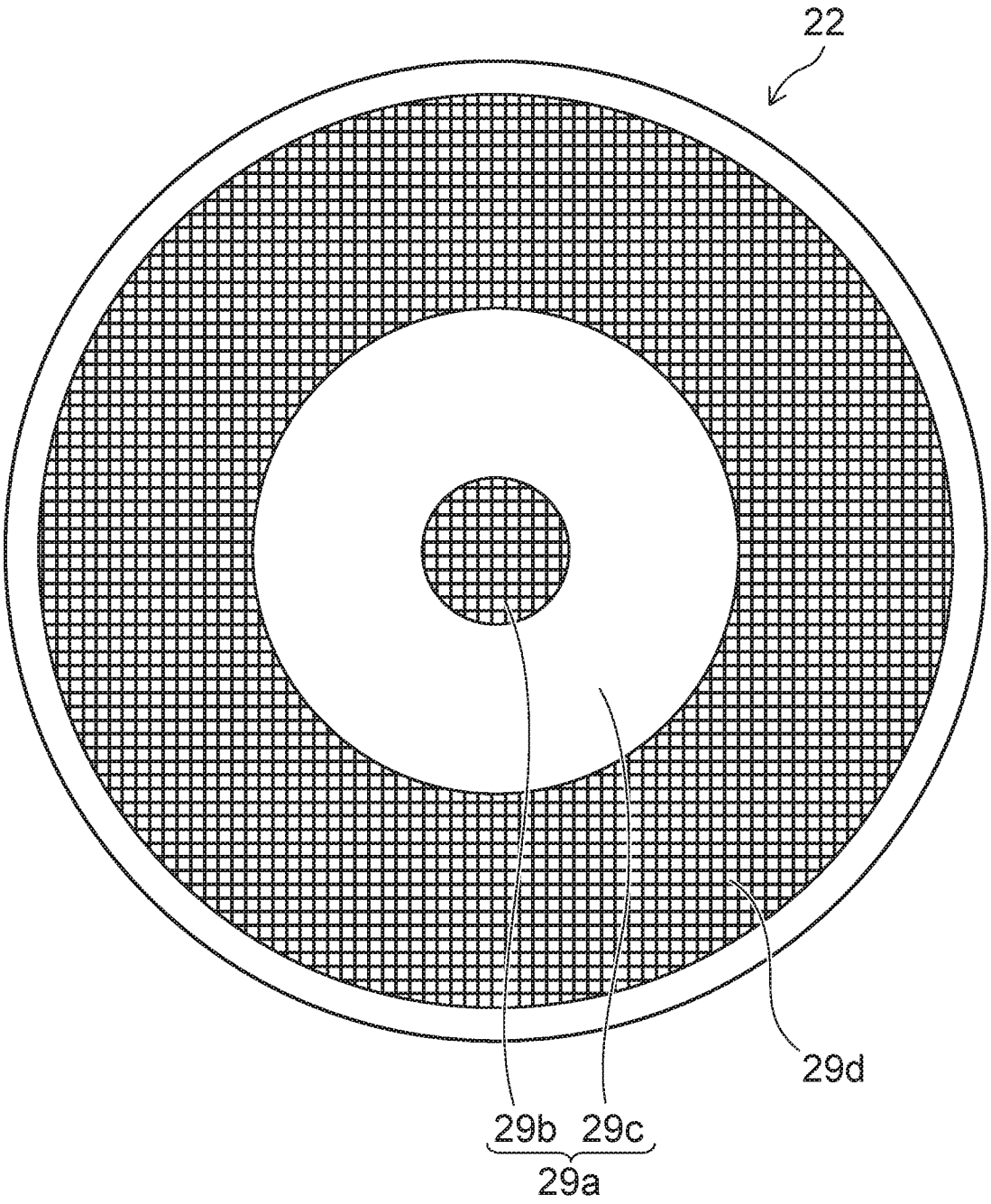
FIG. 18 is a bottom view showing the optical member according to the second embodiment.

FIG. 18 is a bottom view showing the optical member 22 according to the embodiment.

FIG. 16 shows a cross section along line B-B' shown in FIG. 17.

As a general rule in the following description, only the differences with the first embodiment are described. Other than the items described below, the embodiment is similar to the first embodiment. This is similar for the other embodiments described below as well.

The lighting device according to the embodiment includes the optical member 22. The concentrator 30 and a first tubular body 45 are provided in the optical member 22. The configuration of the concentrator 30 is similar to that of the first embodiment. The first tubular body 45 is transparent. For example, the optical member 22 is formed to have a continuous body of a transparent material.

Similarly to the first tubular body 40 of the first embodiment, the first tubular body 45 generally has a circular tubular configuration surrounding the prism portion 32. In the first tubular body 45, the cross-sectional configuration of a surface including the central axis C of the optical member 22 is a substantially trapezoid. The surface of the first tubular body 40 facing the light incident direction includes an inner side surface 45*a*, an upper surface 45*b*, and an outer side surface 45*c*. The inner side surface 45*a* is in contact with the outer side surface 32*c* of the prism portion 32 and is tilted away from the central axis C toward the light incident direction. The upper surface 45*b* is a circular-ring shaped flat surface orthogonal to the central axis C. The outer side surface 40*c* may be parallel to the central axis C or may be tilted in a direction away from the central axis C toward the light emission direction.

Multiple recesses 41*b*, 41*c*, and 41*d* are formed at one end portion 45*e* of the first tubular body 45. The portions of the first tubular body 45 between the adjacent recesses are the light guide portions. Specifically, in the first tubular body 45, the portion between the recess 41*b* and the recess 41*c* is the first light guide portion 42; the portion between the recess 41*c* and the recess 41*d* is the second light guide portion 43; and the portion between the recess 41*d* and the recess 41*b* is a third light guide portion 44. Thus, three types of light guide portions are provided in the first tubular body 45. For example, the first light guide portion 42, the second light guide portion 43, and the third light guide portion 44 are repeatedly arranged along the circumferential direction of the first tubular body 45.

The configurations of the first light guide portion 42 and the second light guide portion 43 are similar to those of the first embodiment. The third light guide portion 44 has a pair of side surfaces 44*a*, and an upper surface 44*b* disposed between the pair of side surfaces 44*a*. The upper surface 44*b* is a portion of the upper surface 45*b* of the first tubular body 45. The tilt angle of a side surface 44*a* of the third light guide portion 44 is larger than the tilt angle of the side surface 42*a* of the first light guide portion 42.

In other words, at the outer side surface 45*c* of the first tubular body 45, a direction $V_{44}$ from an intersection 44*c* between the side surface 44*a* of the third light guide portion 44 and the end portion 45*e* of the first tubular body 45 toward a point 44*d* of the side surface 44*a* of the third light guide portion 44 most distal to the end portion 45*e* is tilted at a third angle $\theta_{44}$ with respect to the extension direction of a central axis $C_{44}$ of the third light guide portion 44. The third angle $\theta_{44}$ is larger than a first angle θ1. Similarly to the first embodiment, the first angle $\theta_{42}$ is larger than the second angle $\theta_{43}$. In other words, third angle $\theta_{44}$>first angle $\theta_{42}$>second angle $\theta_{43}$.

The second light-emitting elements 12 of the light source part 10 are disposed at positions corresponding to the first light guide portion 42, the second light guide portion 43, and the third light guide portion 44, e.g., positions opposing the upper surfaces of the light guide portions. One or more second light-emitting elements 12 are disposed at each of positions corresponding to the light guide portions. The second light-emitting elements 12 that are disposed at the positions corresponding to the first light guide portions 42, the second light-emitting elements 12 that are disposed at the positions corresponding to the second light guide portions 43, and the second light-emitting elements 12 that are disposed at the positions corresponding to the third light guide portions 44 can be controlled independently from each other. Also, the color temperatures of the light emitted by the second light-emitting elements 12 corresponding to the light guide portions may be mutually-different or may be the same.

Effects of the embodiment will now be described.

According to the embodiment, the FWHM of the light emitted from the third light guide portion 44 can be smaller than the FWHM of the light emitted from the first light guide portion 42. Thereby, three levels of light distribution angles can be realized and switched using the second light-emitting element 12 and the first tubular body 45. Also, by combining with the first light-emitting element 11 and the concentrator 30, a total of four levels of light distribution angles can be realized and switched.

Third Embodiment

A third embodiment will now be described.

A light-emitting device according to the embodiment includes a light source part 16 and an optical member 23. The lighting device according to the embodiment can be configured using the light-emitting device and the cover member 80 according to the embodiment.

Figure 19:
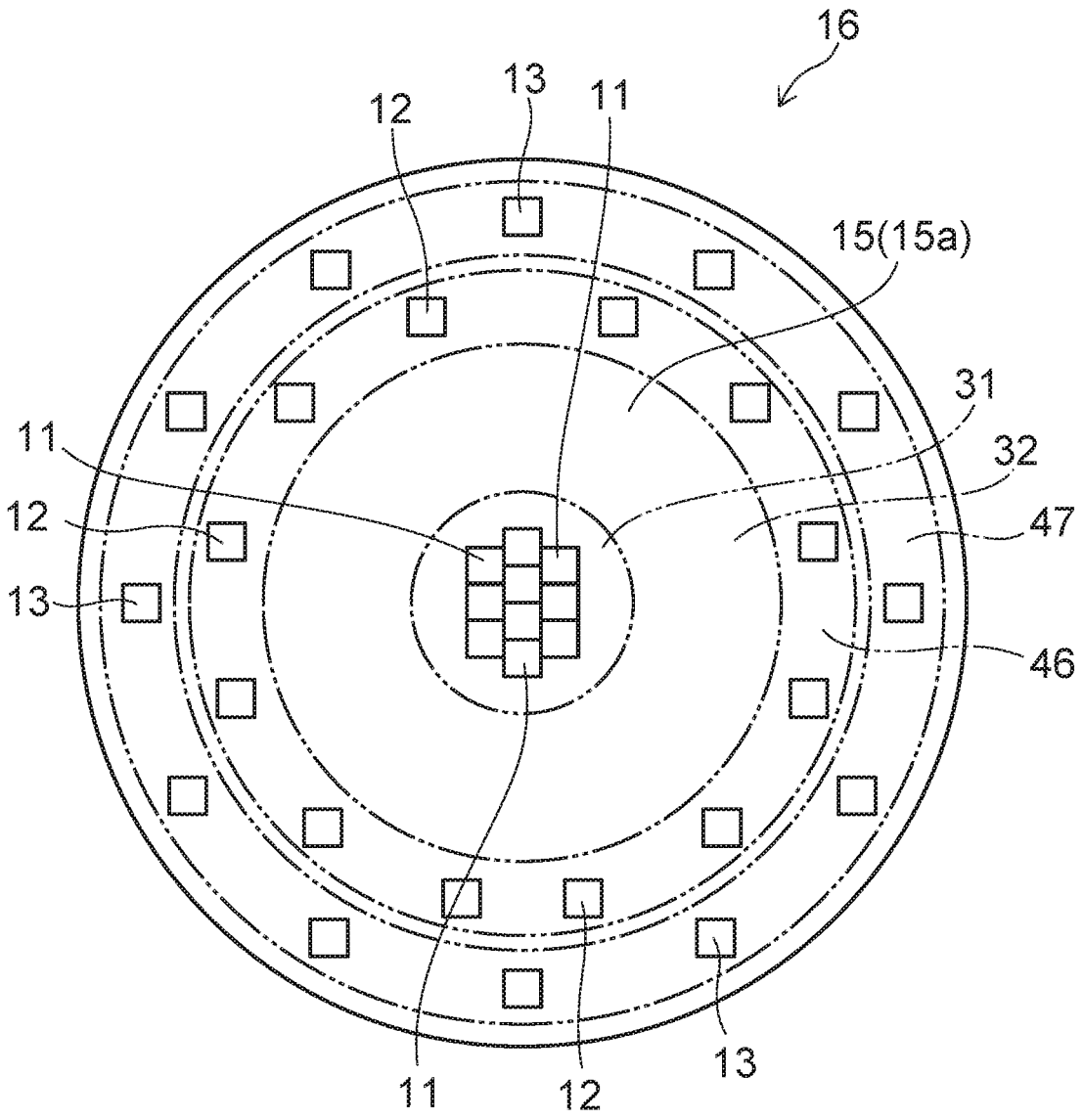
FIG. 19 is a bottom view showing a light source part of a third embodiment.

FIG. 19 is a bottom view showing the light source part 16 of the embodiment.

In the light source part 16, the first light-emitting elements 11, the second light-emitting elements 12, and third light-emitting elements 13 are provided on the mounting surface 15*a* of the wiring substrate 15. One or more, e.g., ten of the first light-emitting elements 11 are provided; and the first light-emitting elements 11 are disposed at the central vicinity of the wiring substrate 15. Two or more, e.g., twelve of the second light-emitting elements 12 are provided; and the second light-emitting elements 12 are disposed in a circular configuration in a region surrounding the ten first light-emitting elements 11. Two or more, e.g., twelve of the third light-emitting elements 13 are provided; and the third light-emitting elements 13 are disposed in a circular configuration in a region surrounding the twelve second light-emitting elements 12. The numbers of the first light-emitting elements 11, the second light-emitting elements 12, and the third light-emitting elements 13 are not limited thereto. The first light-emitting elements 11, the second light-emitting elements 12, and the third light-emitting elements 13 are, for example, LEDs. The first light-emitting elements 11, the second light-emitting elements 12, and the third light-emitting elements 13 can be controlled independently from each other. The color temperature of the light emitted from the third light-emitting element 13 may be the same as or different from the color temperature of the light emitted from the first light-emitting element 11 or the second light-emitting element 12.

Figure 20:
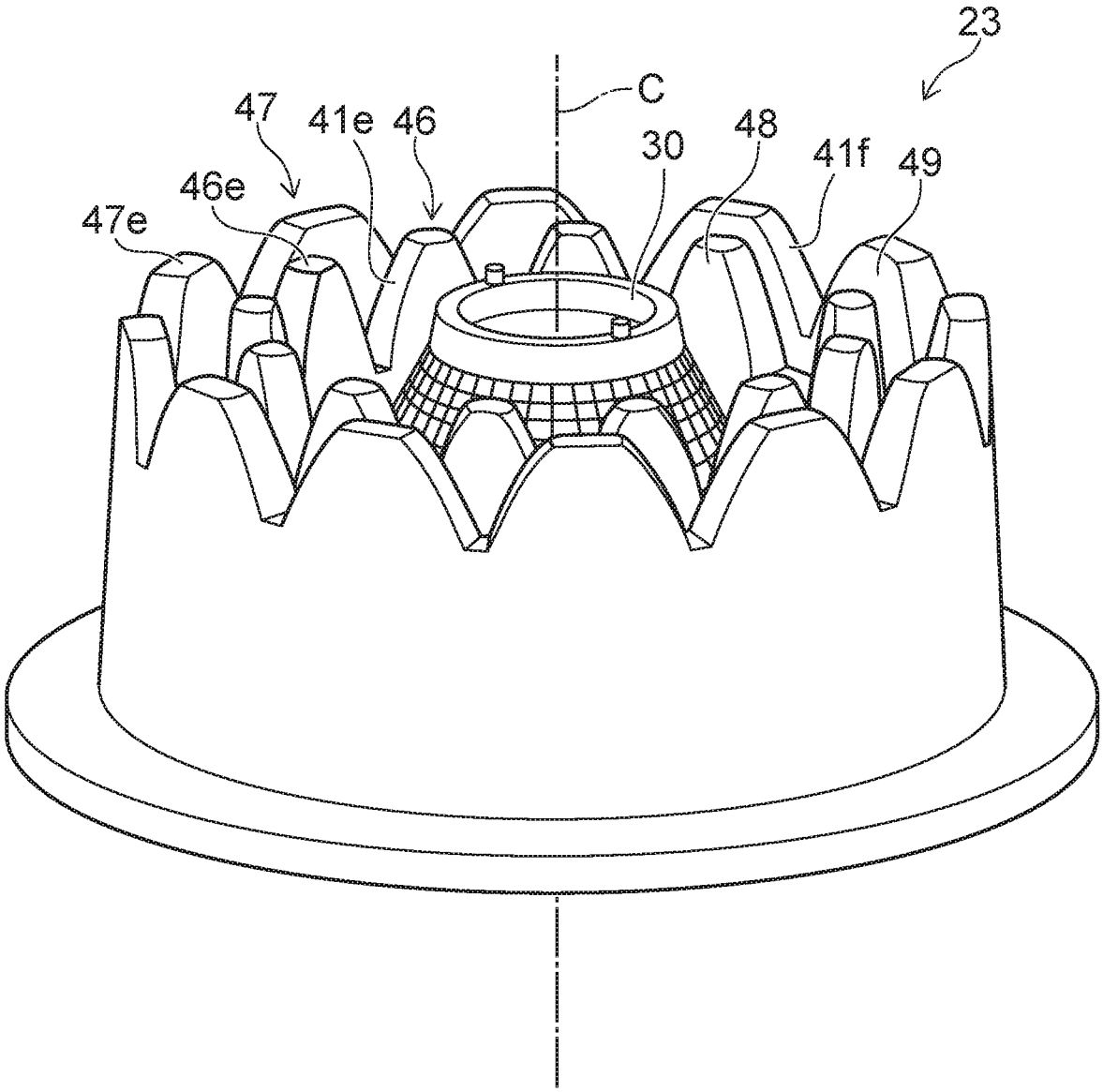
FIG. 20 and FIG. 21 are perspective views showing an optical member according to the third embodiment.
Figure 21:
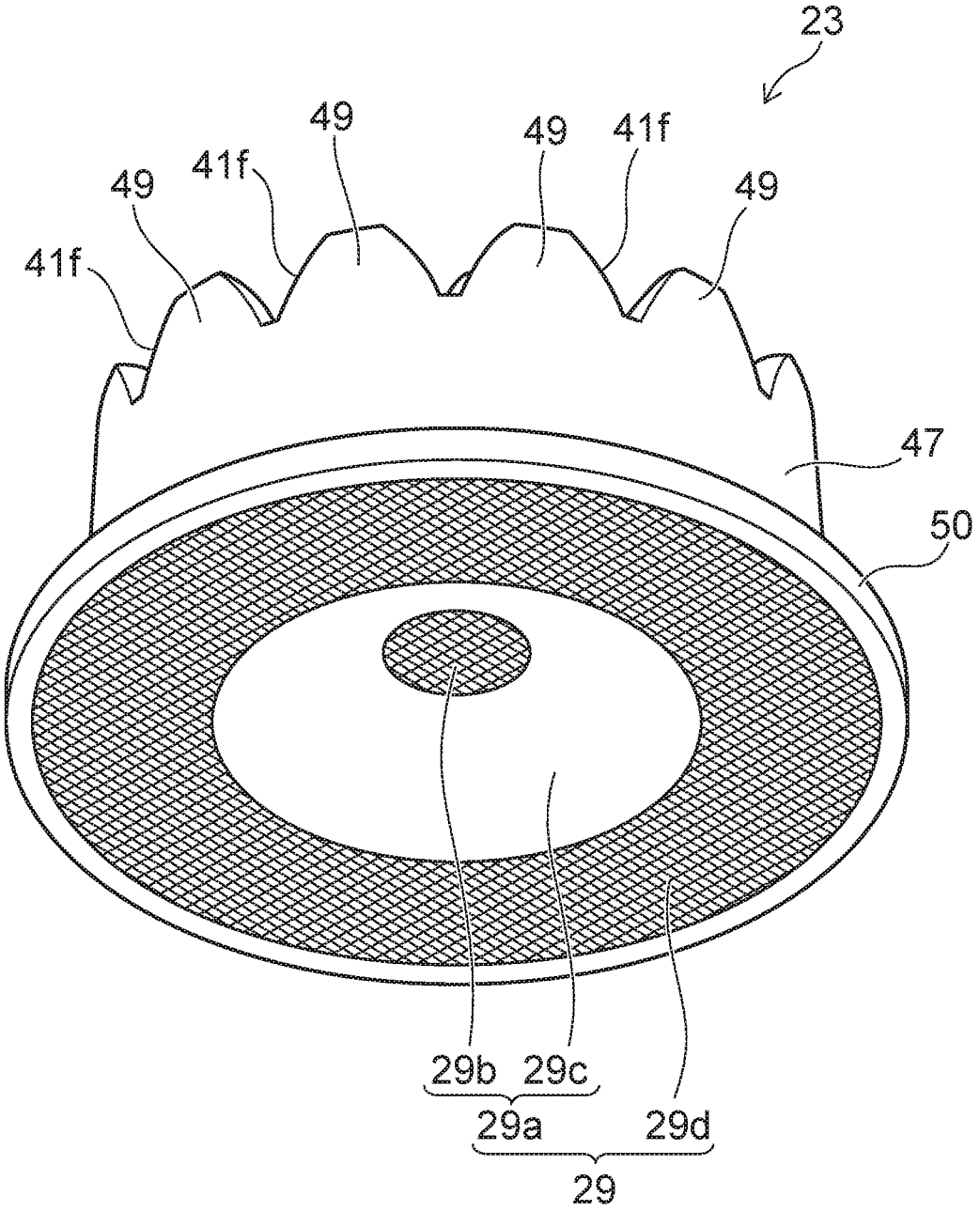

FIG. 20 and FIG. 21 are perspective views showing the optical member 23 according to the embodiment.

Figure 22:
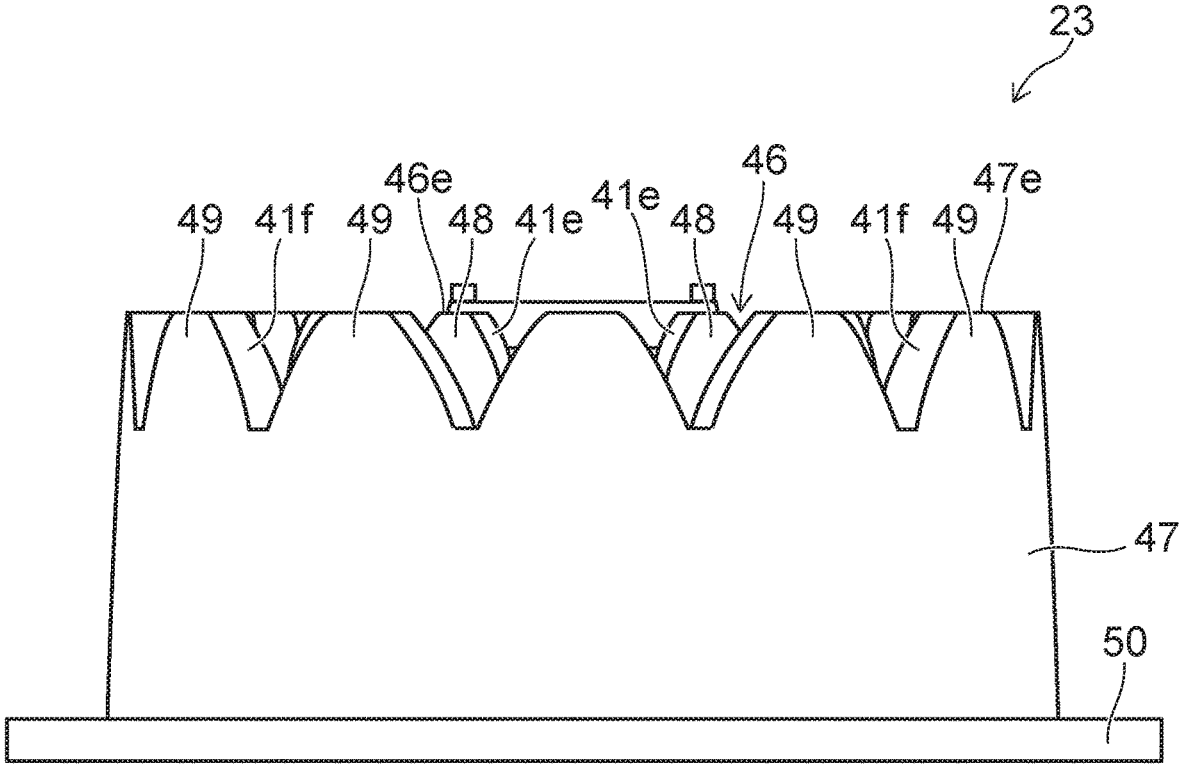
FIG. 22 is a side view showing the optical member according to the third embodiment.

FIG. 22 is a side view showing the optical member 23 according to the embodiment.

Figure 23:
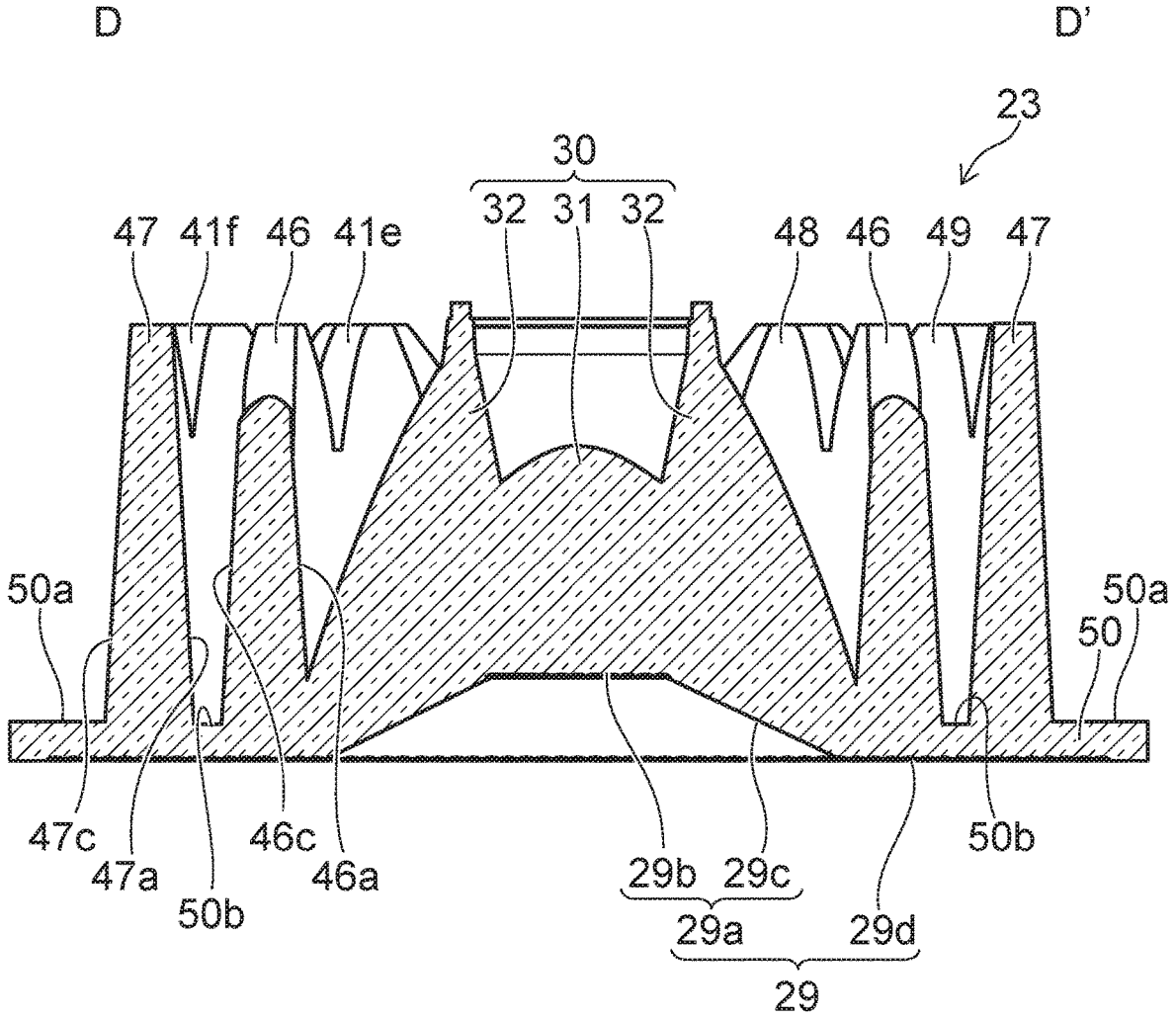
FIG. 23 is a cross-sectional view showing the optical member according to the third embodiment.

FIG. 23 is a cross-sectional view showing the optical member 23 according to the embodiment.

Figure 24:
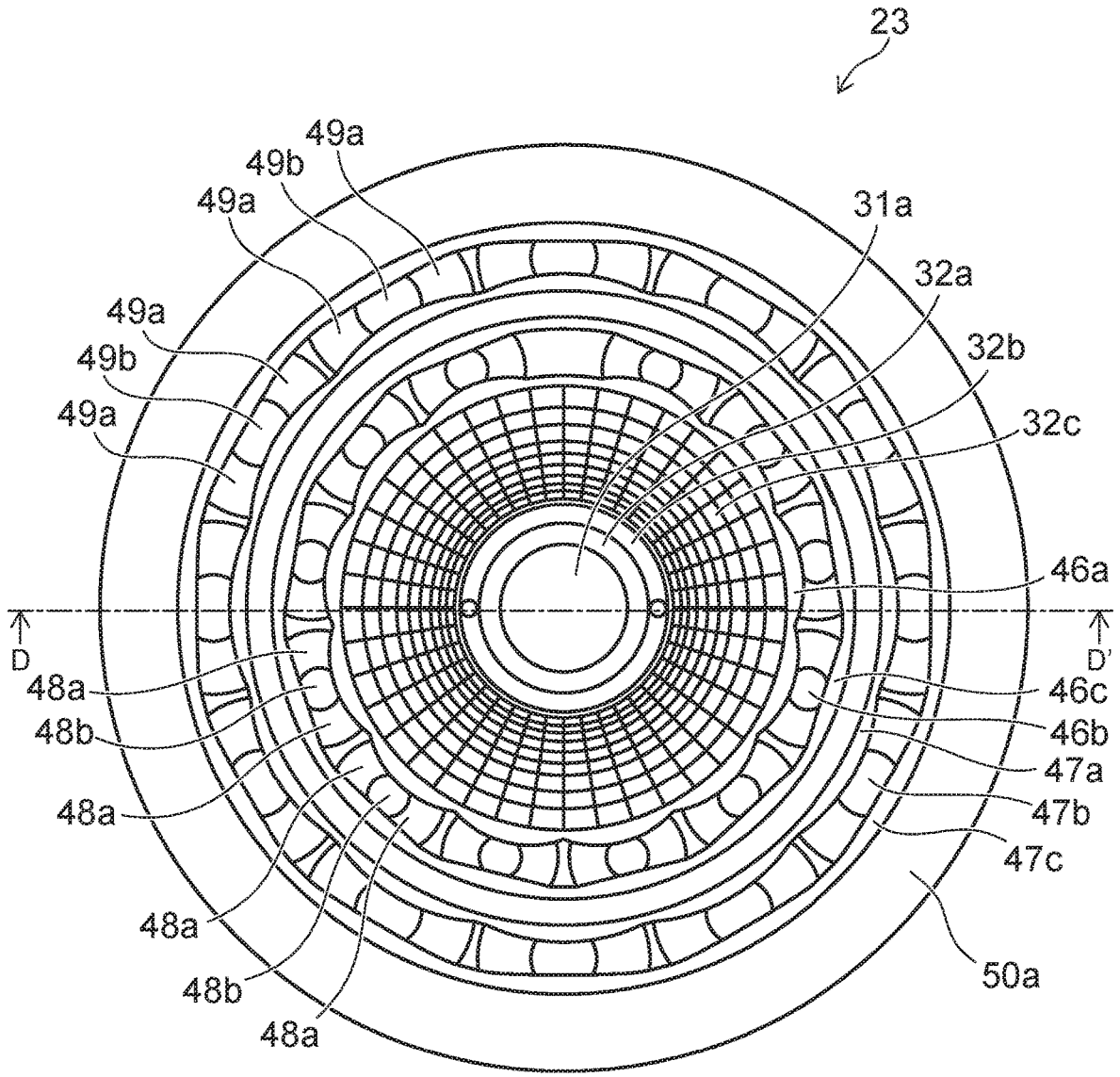
FIG. 24 is a top view showing the optical member according to the third embodiment.

FIG. 24 is a top view showing the optical member 23 according to the embodiment.

Figure 25:
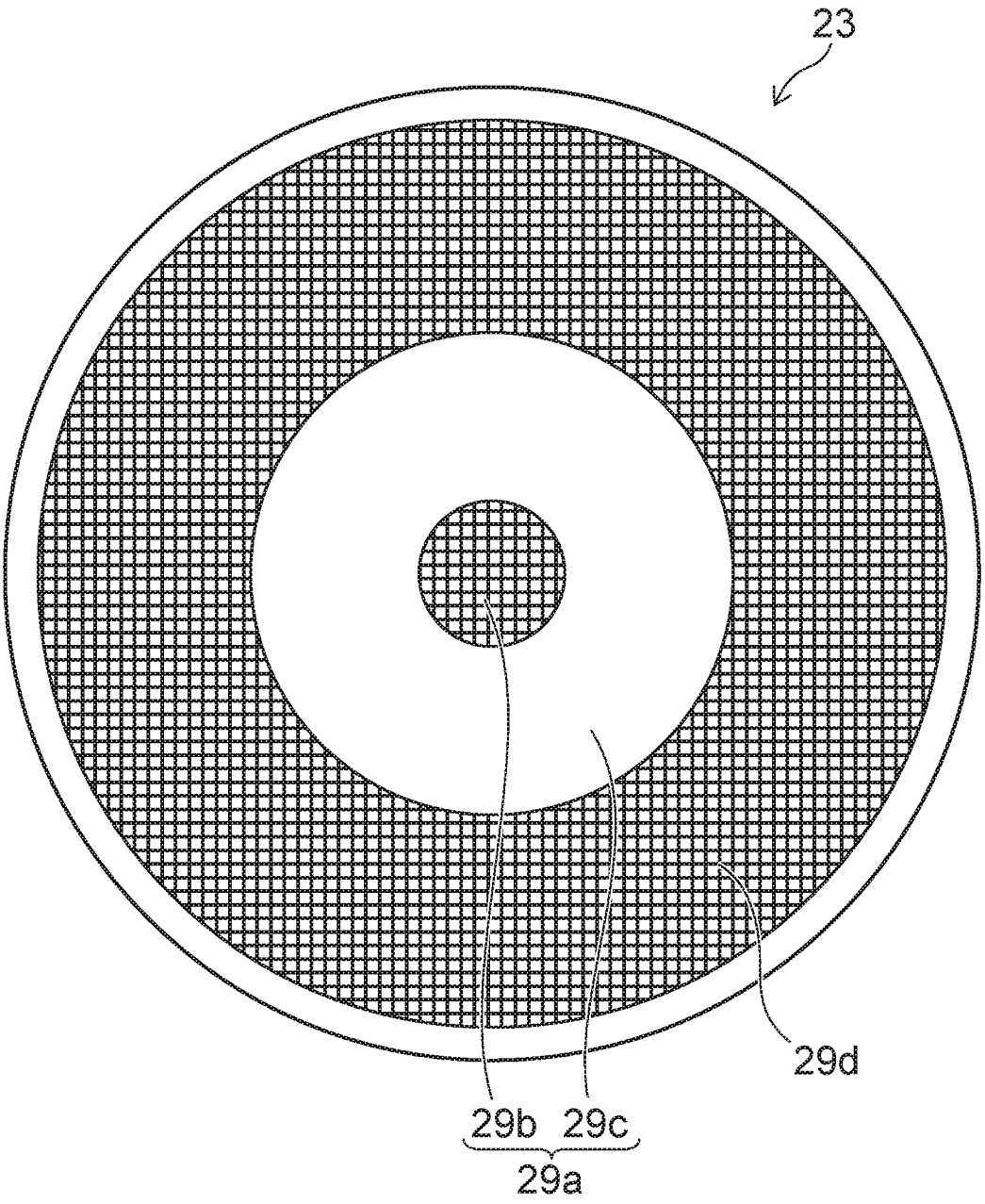
FIG. 25 is a bottom view showing the optical member according to the third embodiment.

FIG. 25 is a bottom view showing the optical member 23 according to the embodiment.

Figure 26A:
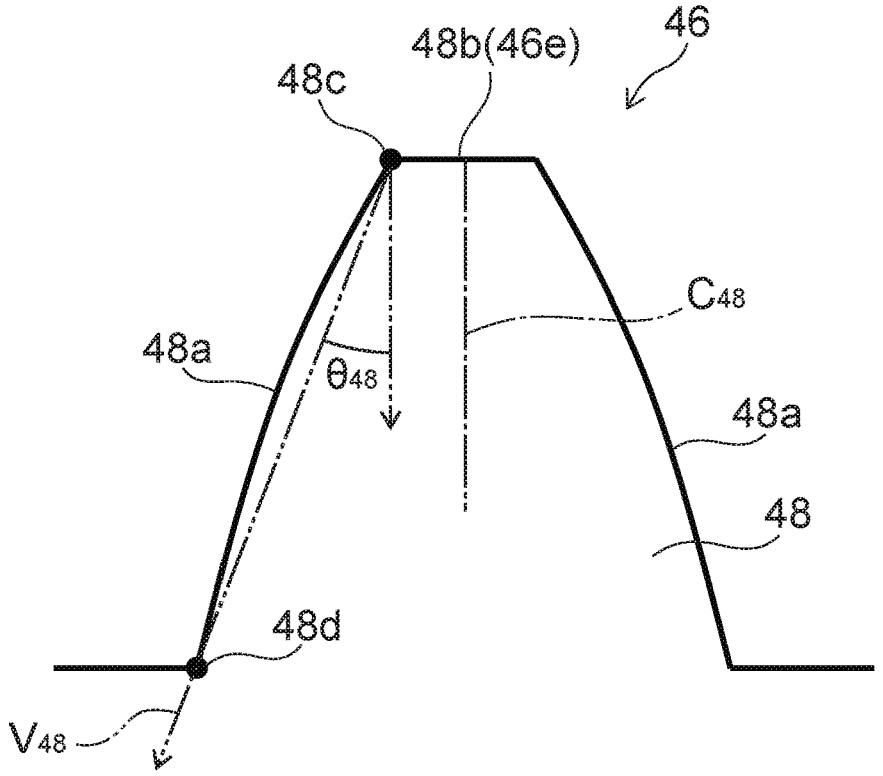
FIG. 26A is a projection view showing a fourth light guide portion of the optical member according to the third embodiment.

FIG. 26A is a projection view showing a fourth light guide portion 48 of the optical member 23 according to the embodiment.

Figure 26B:
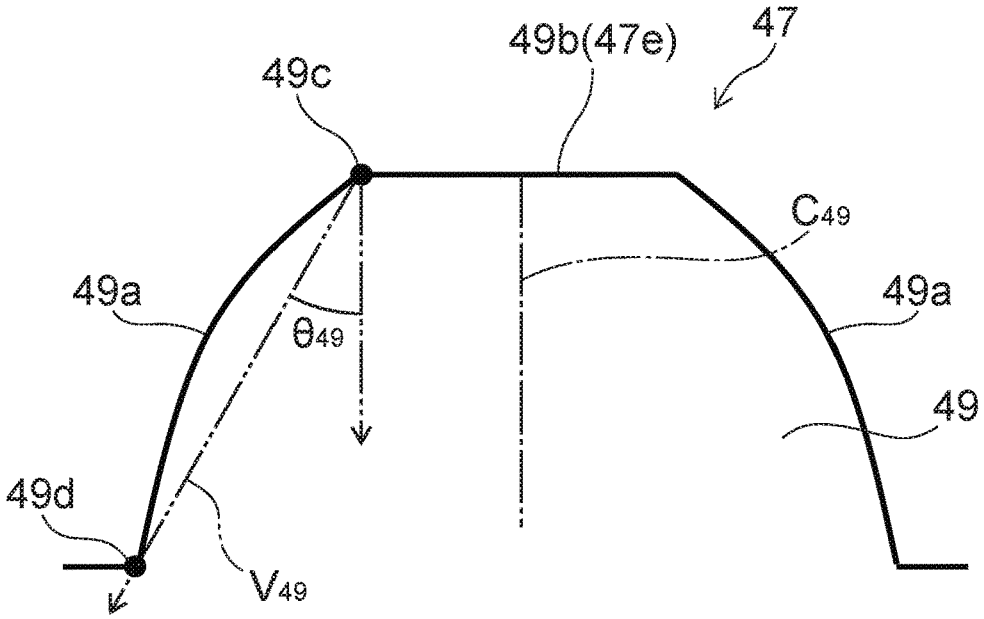
FIG. 26B is a projection view showing a fifth light guide portion of the optical member according to the third embodiment.

FIG. 26B is a projection view showing a fifth light guide portion 49 of the optical member 23 according to the embodiment.

FIG. 23 shows a cross section along line D-D' shown in FIG. 24.

In FIG. 26A and FIG. 26B, the fourth light guide portion 48 and the fifth light guide portion 49, which are curved originally, are projected onto a plane.

The concentrator 30, a first tubular body 46, and a second tubular body 47 are provided in the optical member 23. The configuration of the concentrator 30 is similar to that of the first embodiment. The first tubular body 46 is a circular tubular member surrounding the concentrator 30. The second tubular body 47 is a circular tubular member surrounding the first tubular body 46. The concentrator 30, the first tubular body 46, and the second tubular body 47 each are transparent. For example, the optical member 23 is formed to have a continuous body of a transparent material.

Generally, the configurations of the first tubular body 46 and the second tubular body 47 are similar to those of the first tubular body 40 of the first embodiment. The surface of the first tubular body 46 facing the light incident direction includes an inner side surface 46*a*, an upper surface 46*b*, and an outer side surface 46*c*. The surface of the second tubular body 47 facing the light incident direction includes an inner side surface 47*a*, an upper surface 47*b*, and an outer side surface 47*c*. The inner side surfaces 46*a* and 47*a* are tilted away from the central axis C toward the light incident direction. The upper surfaces 46*b* and 47*b* are circular-ring shaped flat surfaces orthogonal to the central axis C. The outer surfaces 46*c* and 47*c* may be parallel to the central axis C or may be tilted in directions away from the central axis C toward the light emission direction. The inner side surface 47*a* of the second tubular body 47 may be separated from the outer side surface 46*c* of the first tubular body 46. In such a case, a bottom surface 50*b* is provided between the outer side surface 46*c* and the inner side surface 47*a*.

In the first tubular body 46, recesses 41*e* are formed in one end portion 46*e*; and the portions of the first tubular body 46 between the recesses 41*e* are the fourth light guide portions 48. Two or more, e.g., twelve fourth light guide portions 48 are provided in the first tubular body 46 and are arranged along the circumferential direction of the first tubular body 46.

Recesses 41*f* are formed in one end portion 47*e* of the second tubular body 47; and the portions of the second tubular body 47 between the recesses 41*f* are the fifth light guide portions 49. Two or more, e.g., twelve fifth light guide portions 49 are provided in the second tubular body 47 and are arranged along the circumferential direction of the second tubular body 47.

For example, the fourth light guide portion 48 and the fifth light guide portion 49 are arranged alternately. In other words, the recess 41*e* of the first tubular body 46 is disposed between the central axis C of the optical member 23 and the fifth light guide portion 49 of the second tubular body 47. Also, the fourth light guide portion 48 of the first tubular body 46 is disposed between the central axis C of the optical member 23 and the recess 41*f* of the second tubular body 47.

The first light-emitting element 11 of the light source part 16 is disposed at a position corresponding to the convex lens 31 of the concentrator 30. The second light-emitting elements 12 are disposed at positions corresponding to the fourth light guide portions 48 and are disposed at, for example, positions opposing upper surfaces 48*b* of the fourth light guide portions 48. It is favorable for the number of the second light-emitting elements 12 to be the same as or an integer multiple of the number of the fourth light guide portions 48. The third light-emitting elements 13 are disposed at positions corresponding to the fifth light guide portions 49 and are disposed at, for example, positions opposing upper surfaces 49*b* of the fifth light guide portions 49. It is favorable for the number of the third light-emitting elements 13 to be the same as or an integer multiple of the number of the fifth light guide portions 49.

The tilt angle of a side surface 49*a* of the fifth light guide portion 49 is different from the tilt angle of a side surface 48*a* of the fourth light guide portion 48. For example, the tilt angle of the side surface 49*a* of the fifth light guide portion 49 is larger than the tilt angle of the side surface 48*a* of the fourth light guide portion 48. More specifically, a fifth angle $\theta_{49}$ between the extension direction of a central axis $C_{49}$ of the fifth light guide portion 49 and a direction $V_{49}$ from an intersection 49*c* between the side surface 49*a* of the fifth light guide portion 49 and the end portion 47*e* of the second tubular body 47 toward a point 49*d* of the side surface 49*a* of the fifth light guide portion 49 most distal to the end portion 47*e* at the outer side surface 47*c* of the second tubular body 47 is larger than a fourth angle $\theta_{48}$ between the extension direction of a central axis $C_{48}$ of the fourth light guide portion 48 and a direction $V_{48}$ from an intersection 48*c* between the side surface 48*a* of the fourth light guide portion 48 and the end portion 46*e* of the first tubular body 46 toward a point 48*d* of the side surface 48*a* of the fourth light guide portion 48 most distal to the end portion 46*e* at the outer side surface 46*c* of the first tubular body 46.

Effects of the embodiment will now be described.

In the embodiment, the outer diameter of the optical member 23 can be small because the fourth light guide portion 48 and the fifth light guide portion 49 are disposed separately in the first tubular body 46 and the second tubular body 47. The lighting device can be downsized even more thereby.

Fourth Embodiment

A fourth embodiment will now be described.

A light-emitting device 2 according to the embodiment includes the light source part 10 and an optical member 24. The configuration of the light source part 10 is similar to that of the first embodiment. The optical member 24 includes a concentrator 33, the first tubular body 40, and the flat plate portion 50. The configurations of the first tubular body 40 and the flat plate portion 50 are similar to those of the first embodiment. A concave mirror 60 is provided at the concentrator 33. The lighting device according to the embodiment can be configured using the light-emitting device 2 and the cover member 80.

Figure 27:
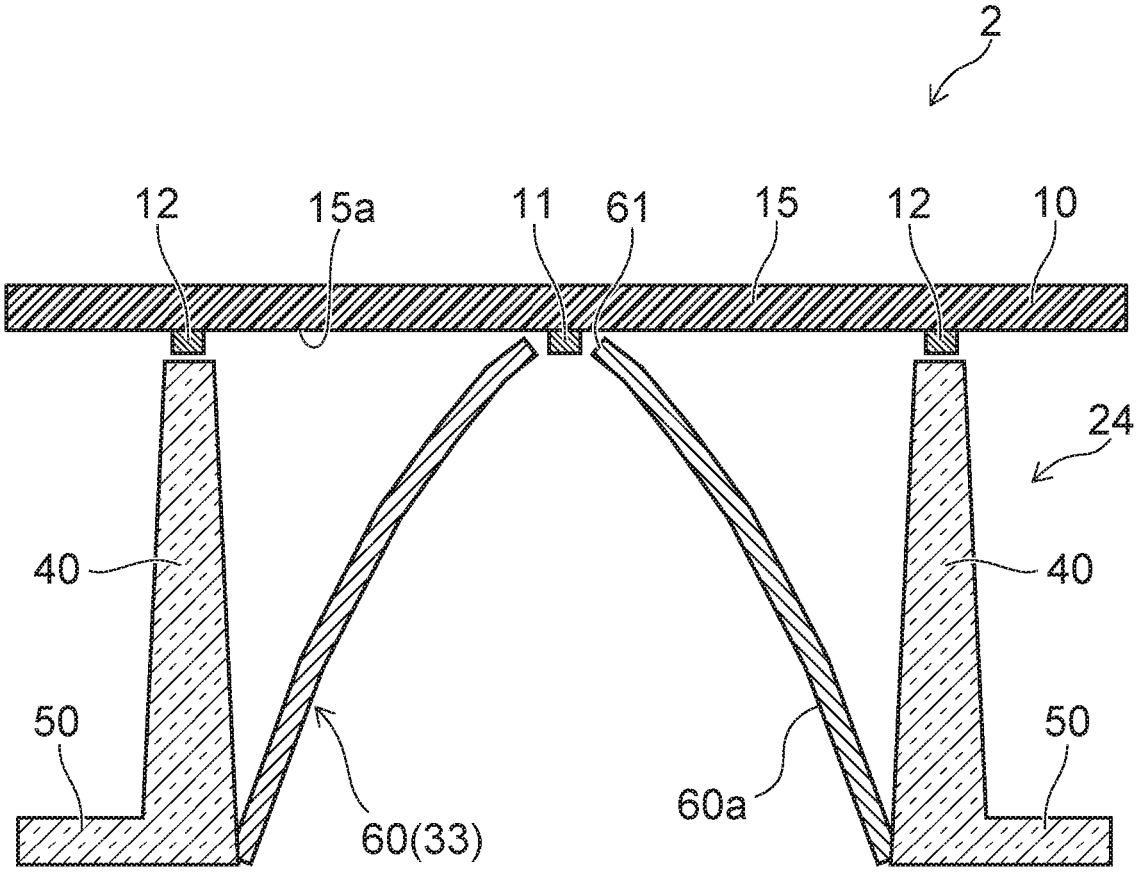
FIG. 27 is an end view showing a light-emitting device according to a fourth embodiment.

FIG. 27 is an end view showing the light-emitting device 2 according to the embodiment.

Figure 28:
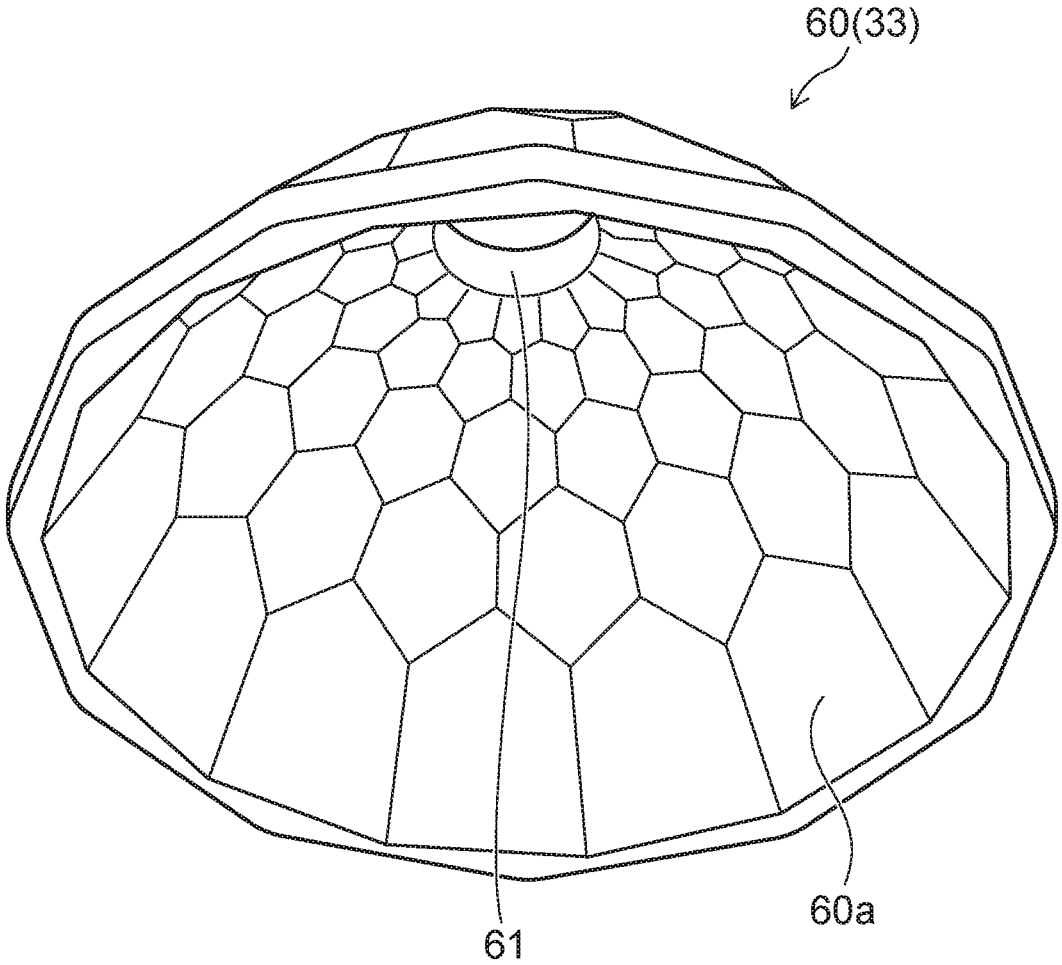
FIG. 28 is a perspective view showing a concave mirror of an optical member according to the fourth embodiment.

FIG. 28 is a perspective view showing the concave mirror 60 of the optical member 24 according to the embodiment.

The concave mirror 60 has substantially a cup configuration; and the inner surface of the concave mirror 60 is a mirror surface. Faceting of an inner surface 60*a* of the concave mirror 60 may be performed. Due to the faceting, the inner surface 60*a* of the concave mirror 60 includes multiple tile-shaped flat surfaces. Thereby, the light can be diffused; and the grainy appearance of the light-emitting elements can be reduced. An opening 61 is formed in the apex portion of the concave mirror 60. The opening 61 is disposed at a position corresponding to the first light-emitting elements 11 of the light source part 10 and is disposed at, for example, a position opposing the first light-emitting elements 11.

In the light-emitting device 2 according to the embodiment, the light that is emitted from the first light-emitting elements 11 when the first light-emitting elements 11 of the light source part 10 are ON enters the interior of the concave mirror 60 via the opening 61. A portion of the light entering the interior of the concave mirror 60 is reflected and condensed by the inner surface 60*a* of the concave mirror 60. The remainder of the light entering the interior of the concave mirror 60 is directly emitted from the optical member 24. On the other hand, similarly to the first embodiment, the light that is emitted from the second light-emitting elements 12 is emitted by being diffused while being conducted through the first tubular body 40.

In the embodiment, the light that is emitted from the first light-emitting elements 11 can be condensed by the concave mirror 60. According to the embodiment, the controllability of the light distribution improves because the light entering the interior of the concave mirror 60 does not leak into the first tubular body 40.

For example, the invention can be utilized in an indoor lighting device, etc.

What is claimed is:

1. A light-emitting device, comprising:

a concentrator;

a first tubular body surrounding the concentrator, being transparent, and having a plurality of recesses formed in an end portion of the first tubular body, the plurality of recesses being arranged adjacent to each other along the perimeter of the first tubular body in a circumferential direction, portions of the first tubular body between the recesses forming light guide portions;

one or more first light-emitting elements disposed at a position corresponding to the concentrator; and a plurality of second light-emitting elements disposed at positions corresponding to a plurality of the light guide portions.

2. The light-emitting device according to claim 1, wherein the light guide portions are wider or constant in a direction away from the end portion.

3. The light-emitting device according to claim 1, wherein the recesses are narrower or constant in a direction away from the end portion.

4. The light-emitting device according to claim 1, wherein a side surface of each light guide portion is curved to be convex toward a respective recess.

5. The light-emitting device according to claim 1, wherein a portion of the plurality of light guide portions is a first light guide portion, and another portion of the plurality of light guide portions is a second light guide portion, at an outer surface of the first tubular body, a direction from an intersection between the end portion and a side surface of the first light guide portion toward a point of the side surface of the first light guide portion most distal to the end portion is tilted at a first angle with respect to an extension direction of a central axis of the first light guide portion, at the outer surface of the first tubular body, a direction from an intersection between the end portion and a side surface of the second light guide portion toward a point of the side surface of the second light guide portion most distal to the end portion is tilted at a second angle with respect to an extension direction of a central axis of the second light guide portion, and the first angle is larger than the second angle.

6. The light-emitting device according to claim 5, wherein the first light guide portion and the second light guide portion are arranged alternately.

7. The light-emitting device according to claim 5, wherein a color temperature of light emitted from the second light-emitting element disposed at a position corresponding to the first light guide portion is different from a color temperature of light emitted from the second light-emitting element disposed at a position corresponding to the second light guide portion.

8. The light-emitting device according to claim 5, wherein the light emitting device further includes another portion of the plurality of light guide portions that is a third light guide portion, wherein at the outer surface of the first tubular body, a direction from an intersection between the end portion and a side surface of the third light guide portion toward a point of the side surface of the third light guide portion most distal to the end portion is tilted at a third angle with respect to an extension direction of a central axis of the third light guide portion, and wherein the third angle is larger than the first angle.

9. The light-emitting device according to claim 1, further comprising:

a second tubular body surrounding the first tubular body, being transparent, and having a plurality of recesses formed in an end portion of the second tubular body, portions of the second tubular body between the recesses forming light guide portions; and a plurality of third light-emitting elements disposed at positions corresponding to a plurality of the light guide portions of the second tubular body.

10. The light-emitting device according to claim 9, wherein an angle at an outer surface of the second tubular body between an extension direction of a central axis of one of the light guide portions of the second tubular body and a direction from an intersection between a side surface of said light guide portion of the second tubular body and the end portion of the second tubular body toward a point of the side surface of said light guide portion of the second tubular body most distal to the end portion of the second tubular body is larger than an angle at the outer surface of the first tubular body between an extension direction of a central axis of one of the light guide portions of the first tubular body and a direction from an intersection between a side surface of said light guide portion of the first tubular body and the end portion of the first tubular body toward a point of the side surface of said light guide portion of the first tubular body most distal to the end portion of the first tubular body.

11. The light-emitting device according to claim 1, wherein the concentrator includes:

a convex lens; and a prism portion having a ring configuration surrounding the convex lens.

12. The light-emitting device according to claim 1, wherein the concentrator includes a concave mirror having an opening formed at a position corresponding to the first light-emitting element.

13. The light-emitting device according to claim 1, wherein the concentrator and the first tubular body are formed to have a continuous body of a transparent material.

14. A lighting device, comprising:

the light-emitting device according to claim 1; and a cover member covering a side surface of the light-emitting device.

15. An optical member, comprising:

a concentrator; and a first tubular body surrounding the concentrator, being transparent, and having a plurality of recesses formed in an end portion of the first tubular body, the plurality of recesses being arranged adjacent to each other along the perimeter of the first tubular body in a circumferential direction, portions of the first tubular body between the recesses forming light guide portions.

16. The optical member according to claim 15, wherein a portion of a plurality of the light guide portions is a first light guide portion, and another portion of the plurality of light guide portions is a second light guide portion, at an outer surface of the first tubular body, a direction from an intersection between the end portion and a side surface of the first light guide portion toward a point of the side surface of the first light guide portion most distal to the end portion is tilted at a first angle with respect to an extension direction of a central axis of the first light guide portion, at the outer surface of the first tubular body, a direction from an intersection between the end portion and a side surface of the second light guide portion toward a point of the side surface of the second light guide portion most distal to the end portion is tilted at a second angle with respect to an extension direction of a central axis of the second light guide portion, and the first angle is larger than the second angle.

17. The optical member according to claim 16, wherein the first light guide portion and the second light guide portion are arranged alternately.

18. The optical member according to claim 16, wherein the optical member further includes another portion of the plurality of light guide portions that is a third light guide portion, wherein at the outer surface of the first tubular body, a direction from an intersection between the end portion and a side surface of the third light guide portion toward a point of the side surface of the third light guide portion most distal to the end portion is tilted at a third angle with respect to an extension direction of a central axis of the third light guide portion, and wherein the third angle is larger than the first angle.

* * * * *